US007614094B2

(12) United States Patent
Wolfe

(10) Patent No.: US 7,614,094 B2
(45) Date of Patent: Nov. 10, 2009

(54) MACHINE AND METHOD FOR PROACTIVE SENSING AND INTERVENTION TO PRECLUDE SWIMMER ENTRAPMENT, ENTANGLEMENT OR EVISCERATION

(76) Inventor: Michael Lawrence Wolfe, 22 Old Bridge Way, Ormond Beach, FL (US) 32174

( * ) Notice: Subject to any disclaimer, the term of this patent is extended or adjusted under 35 U.S.C. 154(b) by 0 days.

(21) Appl. No.: 12/228,549

(22) Filed: Aug. 13, 2008

(65) Prior Publication Data

US 2009/0064403 A1 Mar. 12, 2009

Related U.S. Application Data

(63) Continuation-in-part of application No. 11/069,332, filed on Mar. 1, 2005, now abandoned.

(51) Int. Cl.
*E04H 4/00* (2006.01)

(52) U.S. Cl. ..... 4/504; 340/530; 340/540

(58) Field of Classification Search ..... 4/504; 210/85, 90, 134, 143, 144; 700/19, 65; 340/530, 340/540, 573.6
See application file for complete search history.

(56) References Cited

U.S. PATENT DOCUMENTS 2,783,459 A * 2/1957 Lienau et al. ..... 340/530
5,049,859 A * 9/1991 Arnell ..... 340/573.6
5,289,436 A 2/1994 Terhune
5,369,623 A * 11/1994 Zerangue ..... 340/540
5,638,048 A 6/1997 Curry
5,725,359 A 3/1998 Dongo et al.
5,947,700 A 9/1999 McKain et al.
6,039,543 A 3/2000 Littleton
6,059,536 A 5/2000 Stingl
6,227,808 B1 5/2001 McDonough
6,342,841 B1 1/2002 Stingl
6,676,831 B2 1/2004 Wolfe

* cited by examiner

*Primary Examiner*—Tuan N Nguyen

(57) ABSTRACT

A machine and method for anticipatory sensing and intervention to avoid swimmer entrapment, entanglement or evisceration; with a proactive, pre-entrapment, ultrasonic sensor assessing the relative hazard of swimmer proximity to a drain cover. A transducer launches waves into the suction piping and/or drain system, and receives echoes from the drain cover, swimmer limbs, hair or body, and water or wall surface parallel to the drain cover. A transmitter electrically energizes the transducer launching waves into the suction piping and/or drain system. A receiver/processor detects the echoes analog signals from the drain cover and water beyond the pool drain. A Logic and Control element converts the detected signals into reliable information regarding safety/hazard status for a swimmer near a drain. Predetermined logic provides automatic pump shutdown, and alarms as required; including a missing drain cover. A pool alarm mode detects that an object, such as a small child, has fallen in.

19 Claims, 34 Drawing Sheets

Pool Shell Section

Figure 1A:
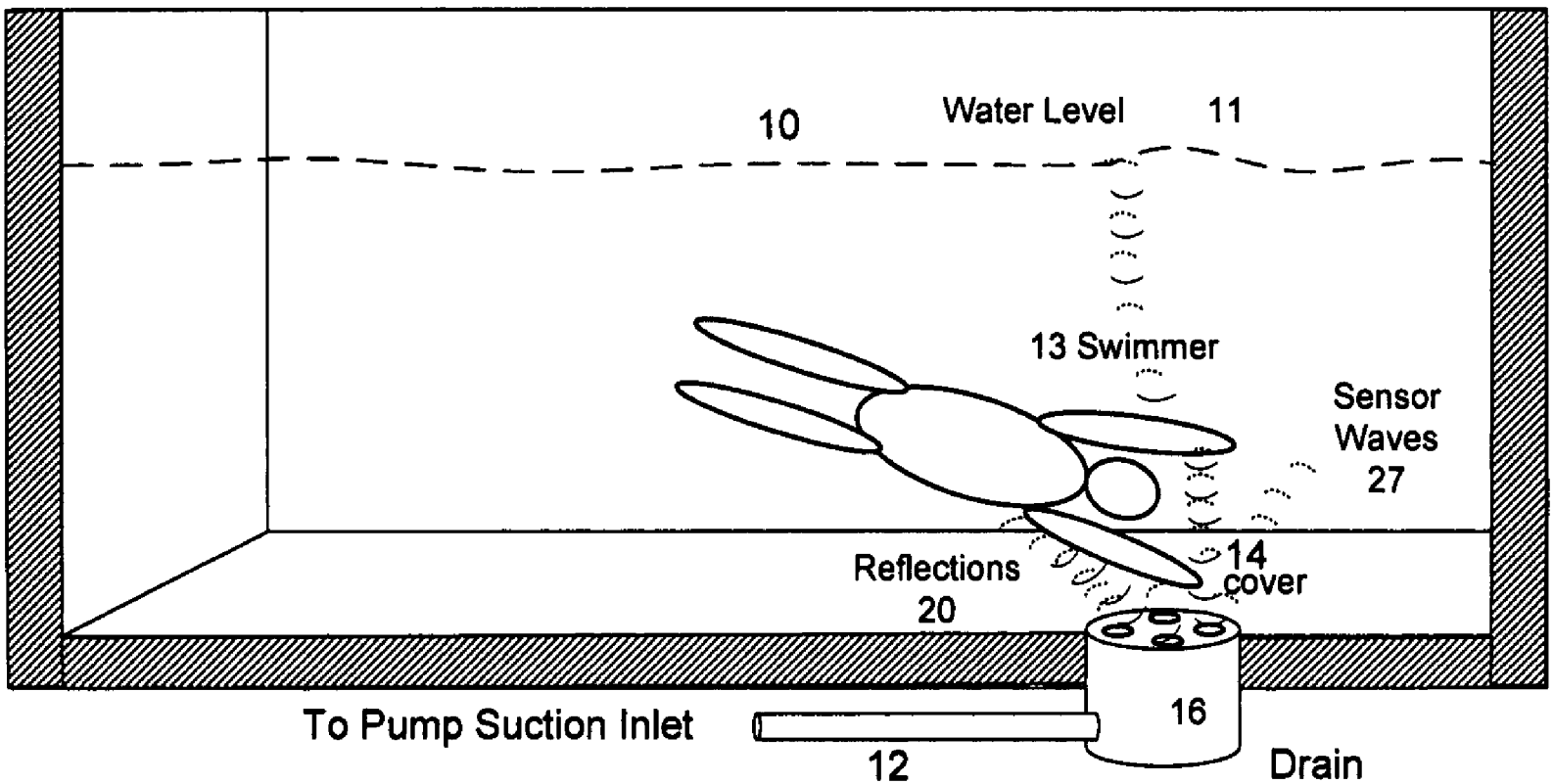

Range Cells are Time Gates and Define Swimmer Location with Respect to the Drain Cover and Water Level. An AGC/STC or Log Amp can Normalize Echoes over a 60 db dynamic range.

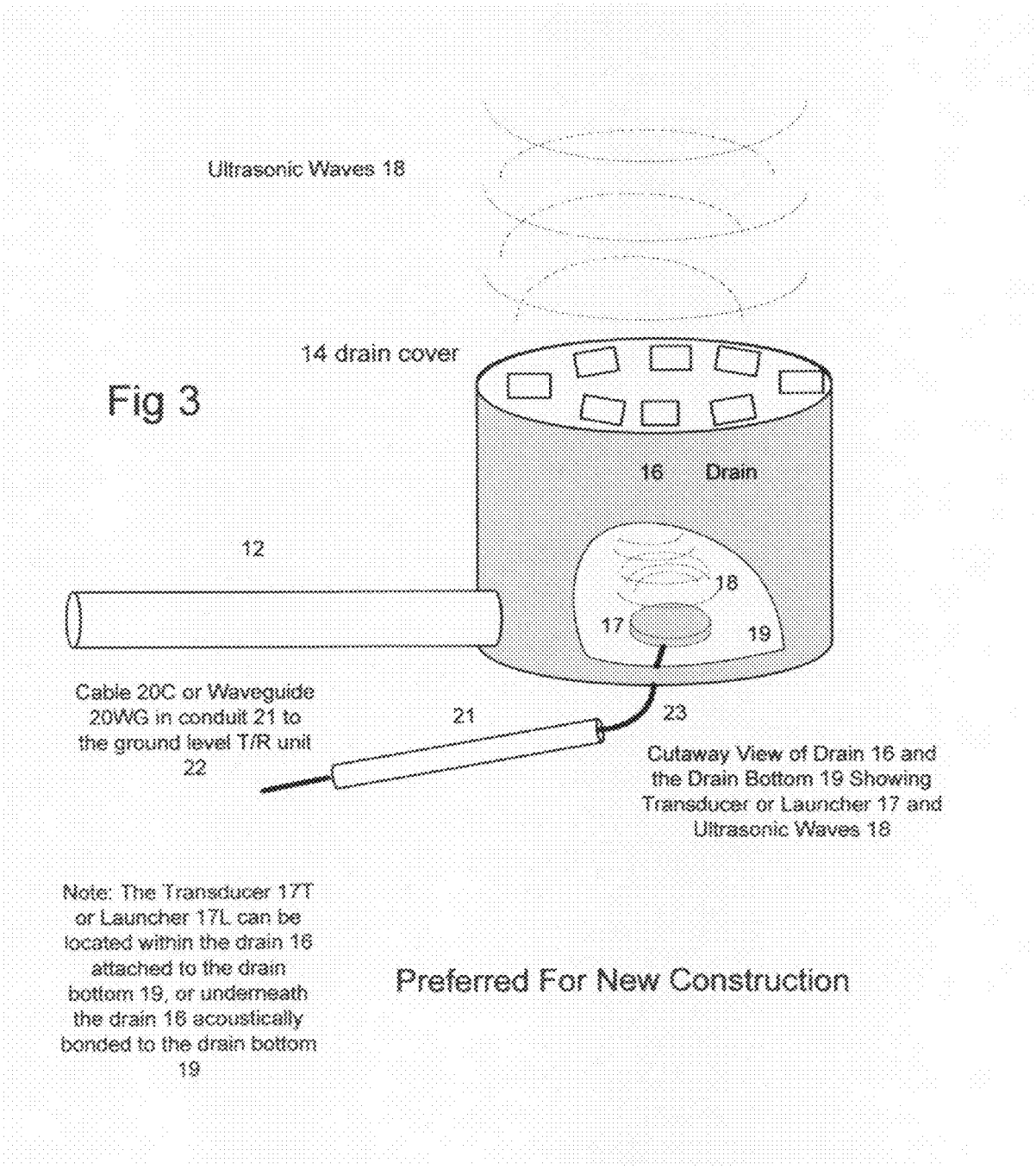
Ultrasonic Waves 18
14 drain cover
Fig 3
16 Drain
12
18
17
19
Cable 20C or Waveguide 20WG in conduit 21 to the ground level T/R unit 22
21
23
Cutaway View of Drain 16 and the Drain Bottom 19 Showing Transducer or Launcher 17 and Ultrasonic Waves 18
Note: The Transducer 17T or Launcher 17L can be located within the drain 16 attached to the drain bottom 19, or underneath the drain 16 acoustically bonded to the drain bottom 19
Preferred For New Construction

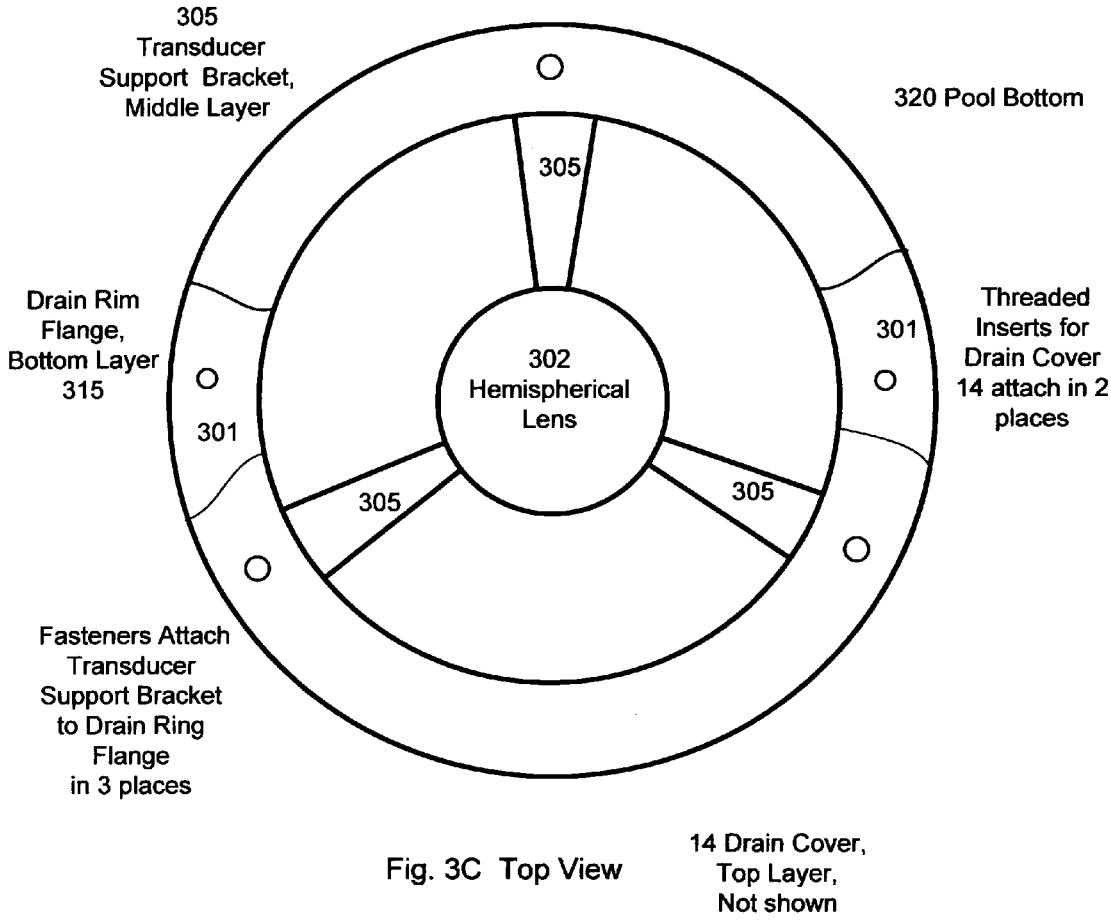
Fig. 3C Top View

Transducer and Acousto-Optics Embodiments

Ultrasonic Transducer and Acousto-Optic Elements Structural Configurations

Table 1: Transducer and Acoustic Lens Elements Embodiments Provide Hemispherical Beam Pattern Above Drain

| Sources and How-To Make | Description | Structure; see Figs. 3 A, B, C, D, E, F, G and H | Advantages | Disadvantages |
|---|---|---|---|---|
| Hemispherical Lens: Plastic Molding in ABS, PVC, et al. D=2.0in.<br><br>Transducer: Standard Spherical Focus, F=1.3, 1 MHz, D=0.75in., f=1.0in.,e.g. Olympus NDT 12-0112-S-SU Immersion Type | Standard Transducer and lens to provide point source focus on axis of solid hemispherical lens.<br><br>Drain Cover per ANSI/APSP Standard | 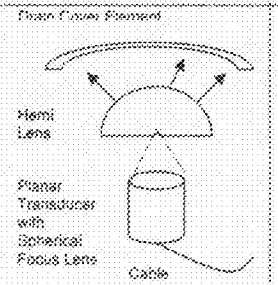 | 1. Standard transducer assembly available from stock.<br>2. Simple Assembly.<br>3. Hemispherical can be plastic molding. Low cost in production<br>4. Hemispherical lens easily acoustically integrated with drain cover to provide composite patterns. | 1. Costly unless custom designed for large volume production.<br>2. Tall height. |
| Hemispherical Lens: Plastic Molding in ABS, PVC, et al. D=2.0in.<br><br>Fresnel Lens: IEEE Ultrasonics Symposium 1993, High Efficiency Fresnel Acoustic Lenses p.579-582; IEEE UFFC Transactions July 1996, FEA of Multilevel acoustic Fresnel Lenses.<br><br>Planar Transducer: Boston Piezo-Optics | Planar Ceramic Disk Transducer energizes Fresnel Lens that focuses point source on axis of solid hemispherical lens.<br><br>Drain Cover per ANSI/APSP Standard | 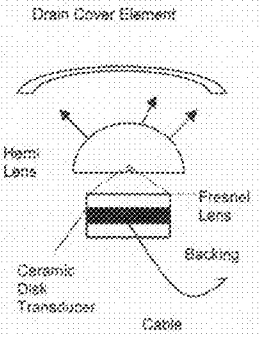 | 1. Simple disk transducer element. Very low cost in production.<br>2. Fresnel Lens very thin.<br>3. Hemispherical lens can be plastic molded and low cost in production.<br>4. Medium size.<br>5. Hemispherical lens easily acoustically integrated with drain cover to provide composite patterns. | 1. Product Development required for low cost in production. |
| Boston Piezo-Optics | Hemispherical Beam derives directly from the Hemispherical Transducer shape<br><br>Drain Cover per ANSI/APSP Standard | 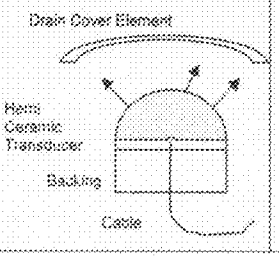 | 1. Transducer functions to provide the beam patterns without a lens.<br>2. Smallest height | 1. Very expensive even in production quantities.<br>2. Complex to build up protective and matching layers externally.<br>3. More difficult to adapt to various drain covers. |

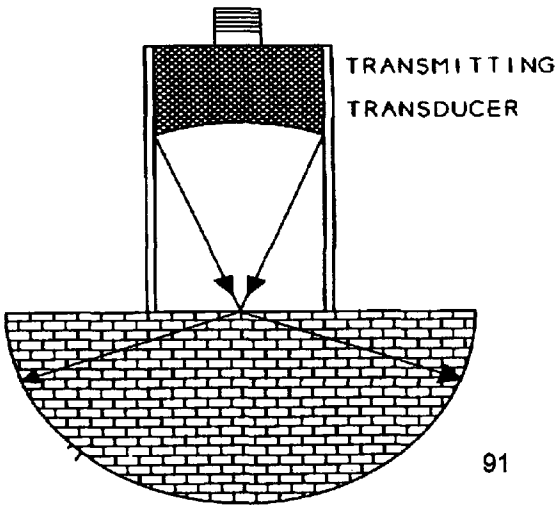
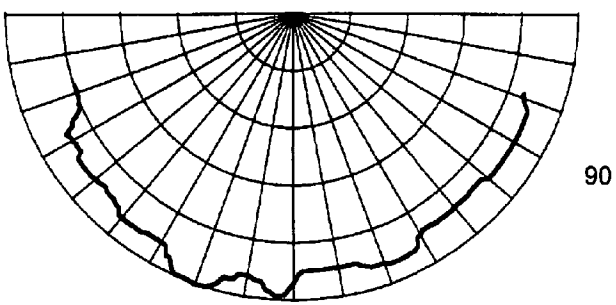
Radiation Pattern as a Function of Elevational Angle for a 1 MHZ, Point Source on a 50 mm Diameter Glass/Thermoplastic Hemisphere. Log (6 dB/div) plot.
Fig. 3G
NIST Prior Art
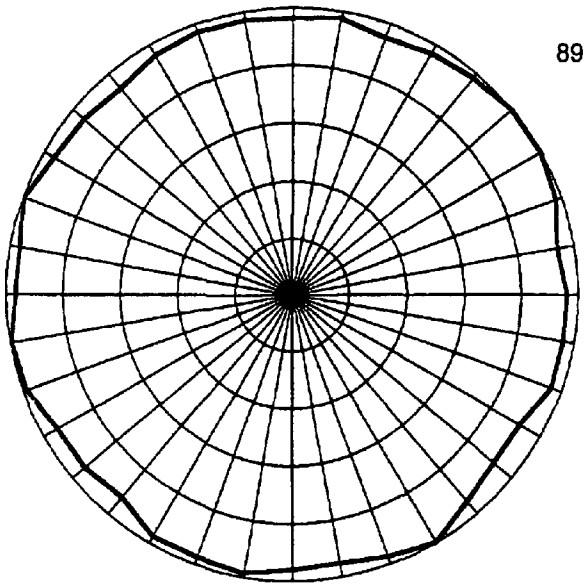
Radiation Pattern as a Function of Azimuthal Angle for a 1 MHZ, Point Source on a 50 mm Diameter Glass/Thermoplastic Hemisphere. Elevational angle set to 45-
ees. Log (6 dB/div) plot.

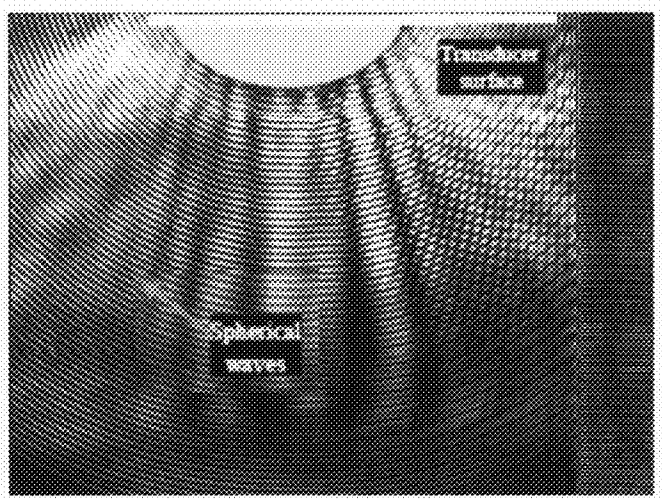

Excerpt from: Development of Broadband, Omni-directional Transducers for NDE Applications.

O. Kettmann-Cordes, et al, Inst. Of High Frequency Engineering, Ruhr-University, Bochum, Germany.

2005 IEEE Ultrasonics Symposium p. 411-414

87 Schematic image of the wave field of a receiver transducer. The transducer surface is shown on the top and wave propagation direction is into the lower half plane. The image shows a successful burst of 20 cycles at 2 MHz [1].

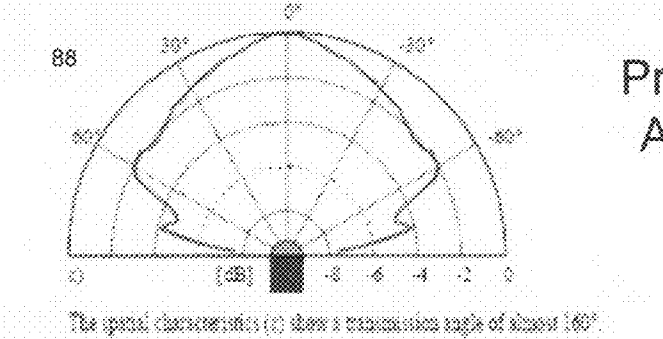

The spatial characteristic (10 dB) of a transducer made of Sensor 160°.

Fig. 3H

Fig. 4a Block Diagram for Remote Transducer with Cable
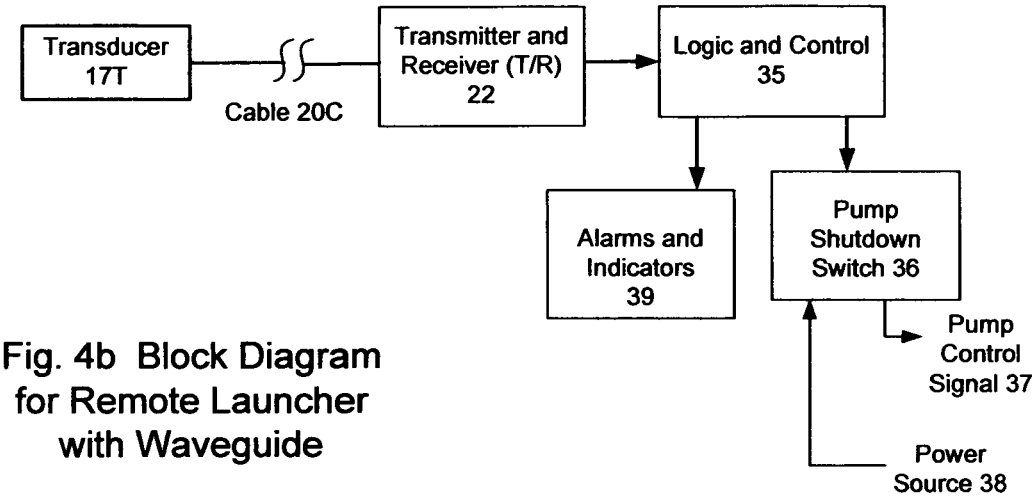
Fig. 4b Block Diagram for Remote Launcher with Waveguide
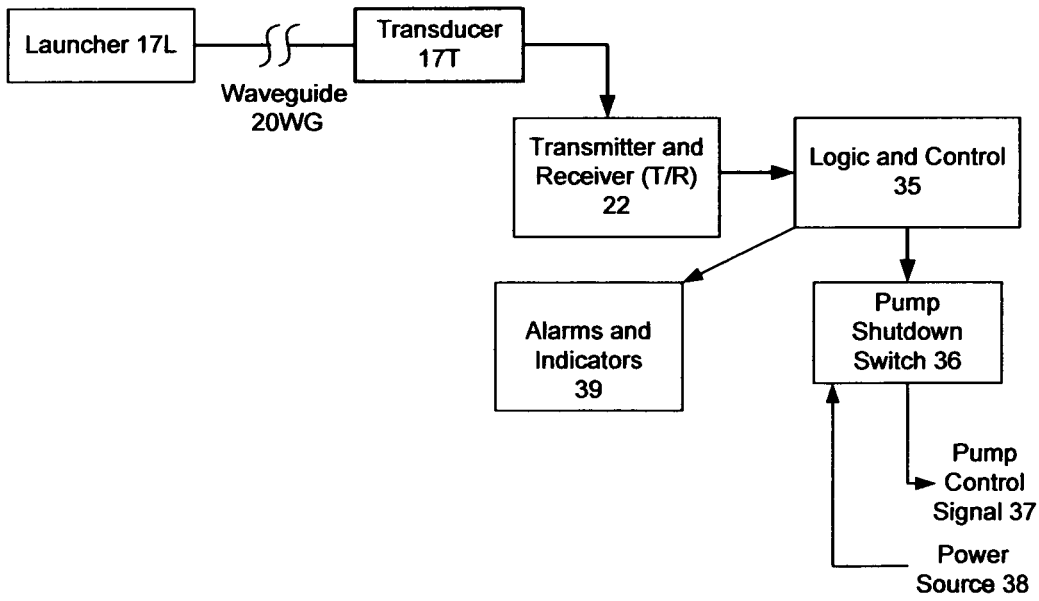

Figure 5 Piping Modification for Axi-symmetric or Cable Ultrasonic Feed
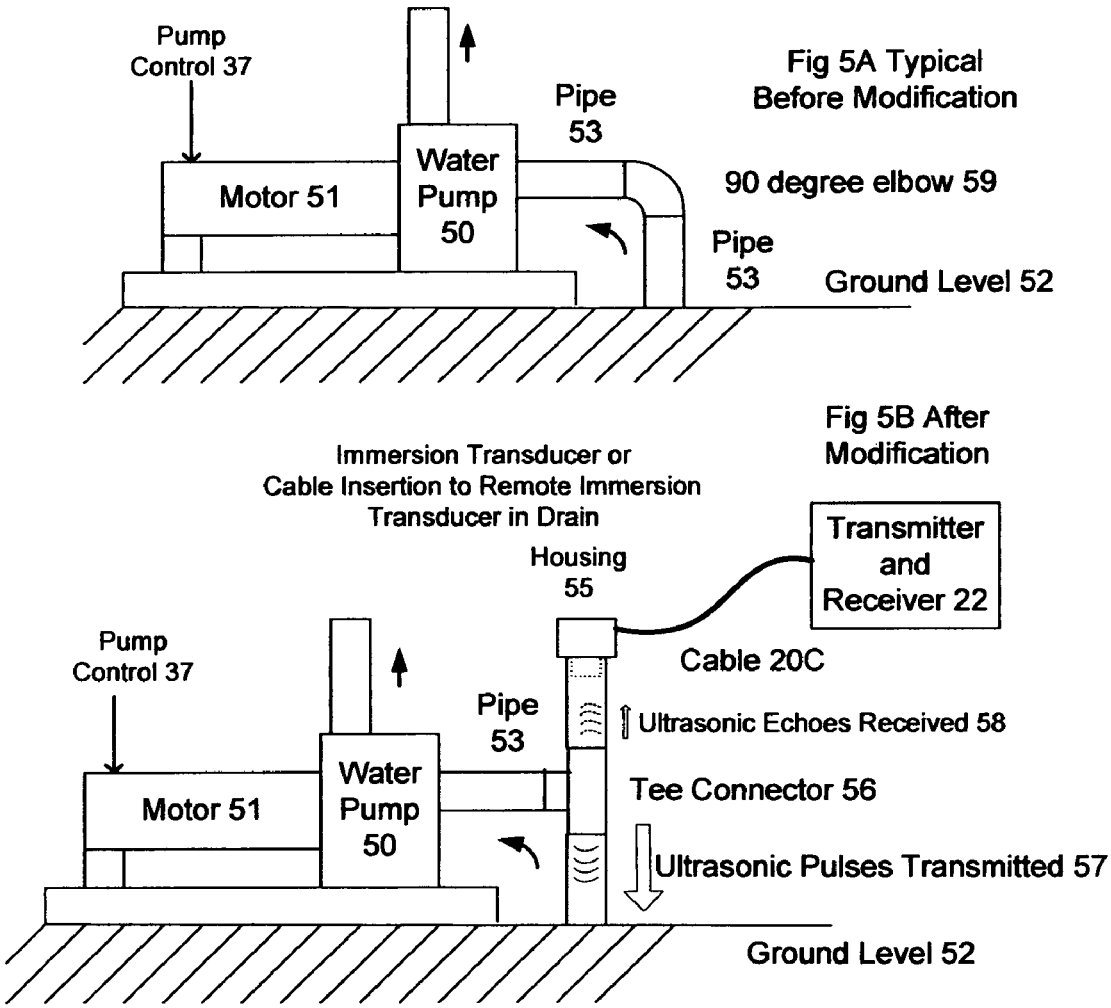
Cable to Drain Preferred for Retrofit Applications Figure 7A Echoes
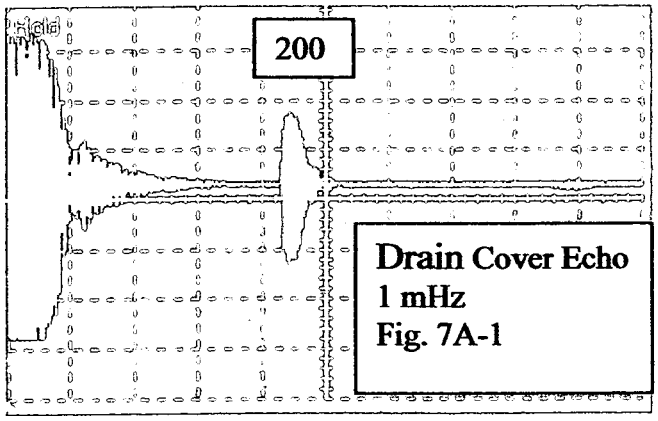
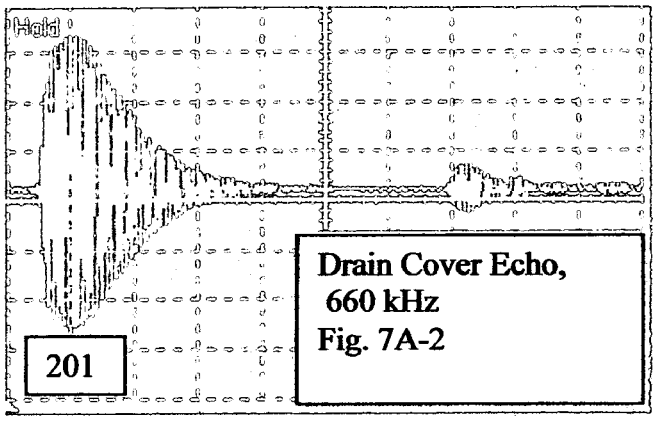
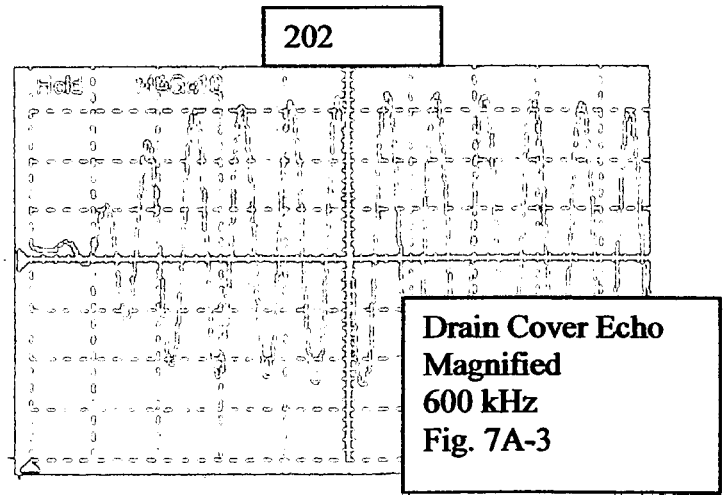

Figure 7B
Echoes
Drain Cover Echo, 1MHz
Fig. 7B-1
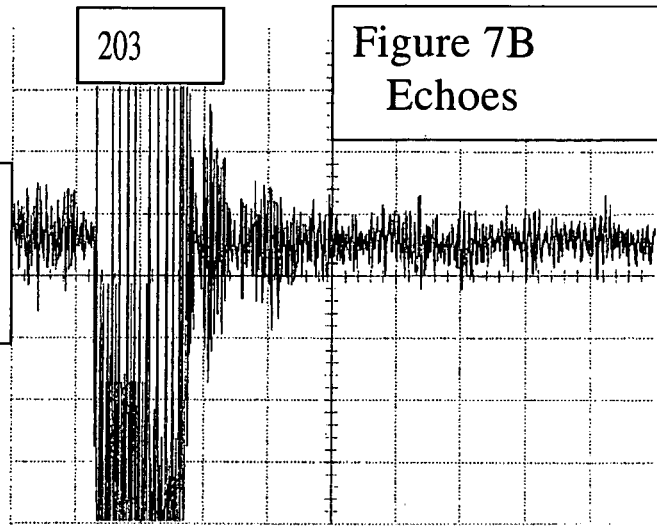
Drain Cover Echo, Hand Echo, 1 MHz
Fig. 7B-2
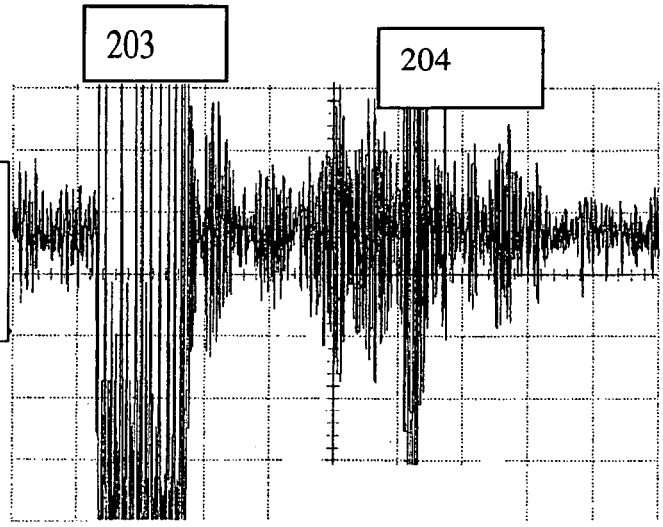
Hand Echo 1 MHz, Magnified 10x
Fig. 7B-3
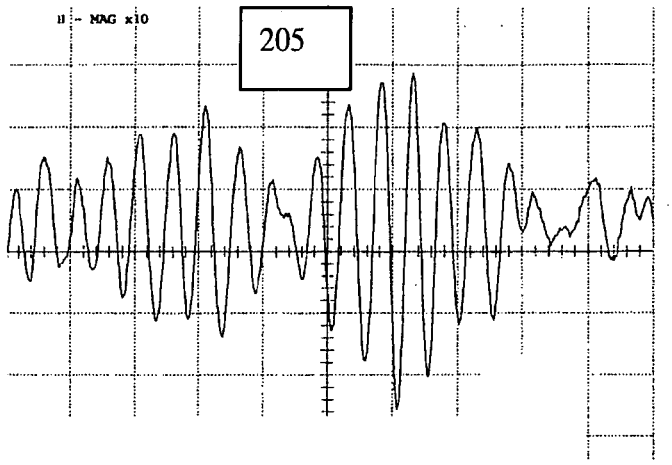

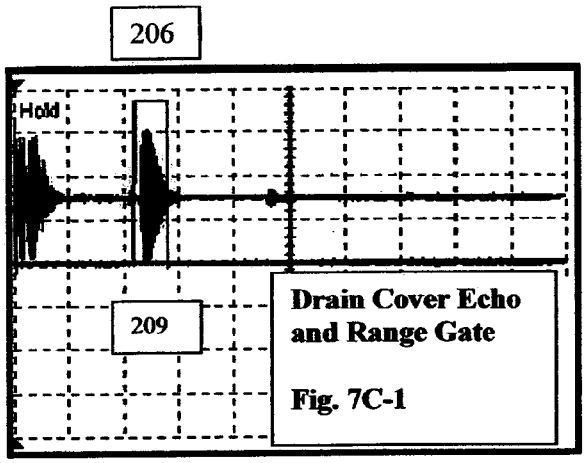
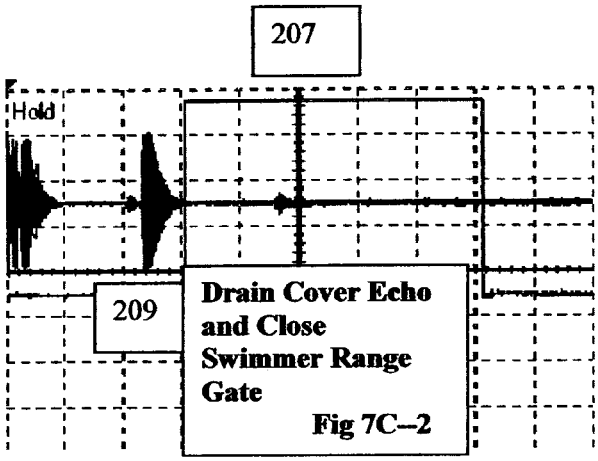
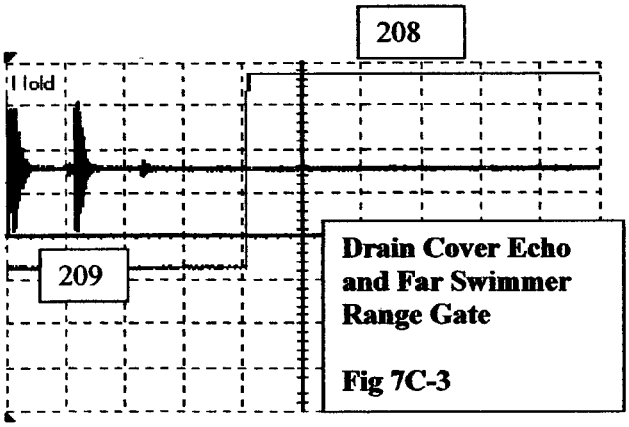
Figure 7C
Echoes and Range Gates

Drain Cover Echo with Hand Echo in NO-Go Gate 640kHz.doc
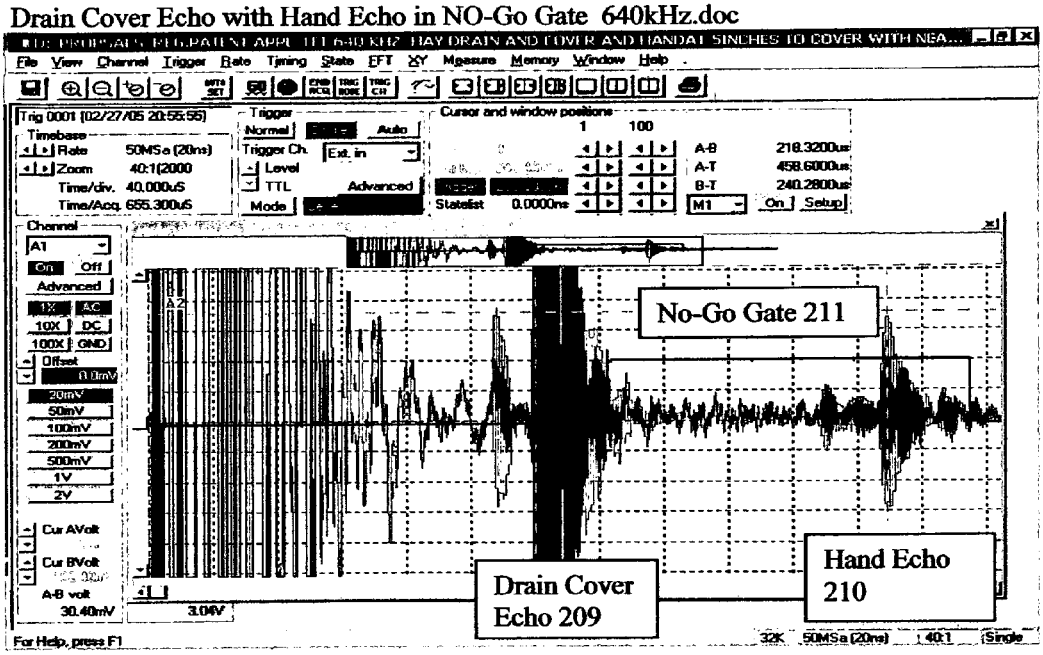
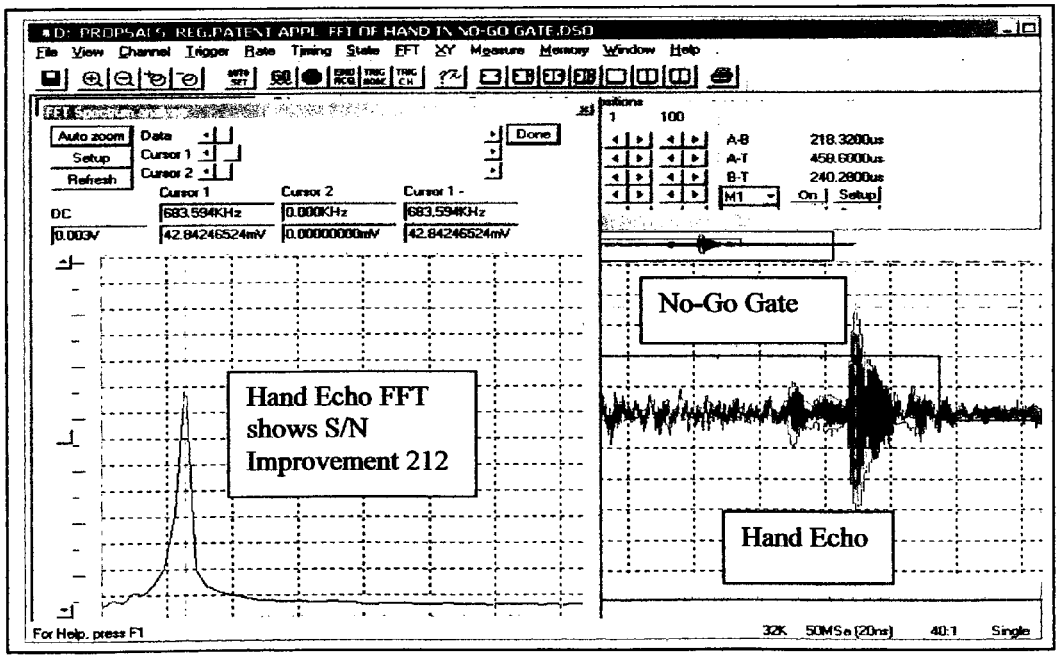
Figure 8A 626 kHz 12ft U Tube (5x2x5)

Figure 8C 200 KHz 10 ft. U Tube
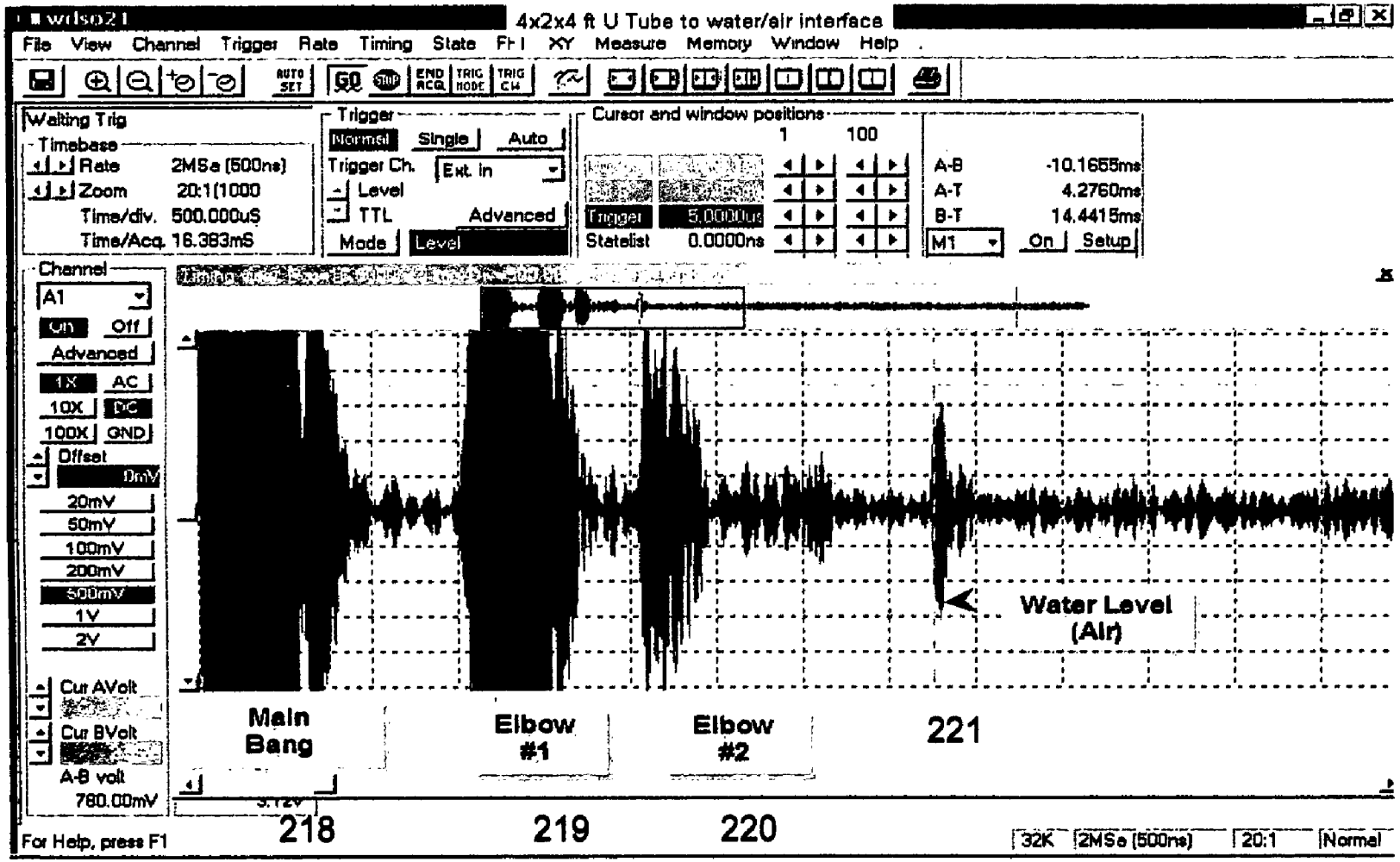

Figure 8D Simplified Propagation Model

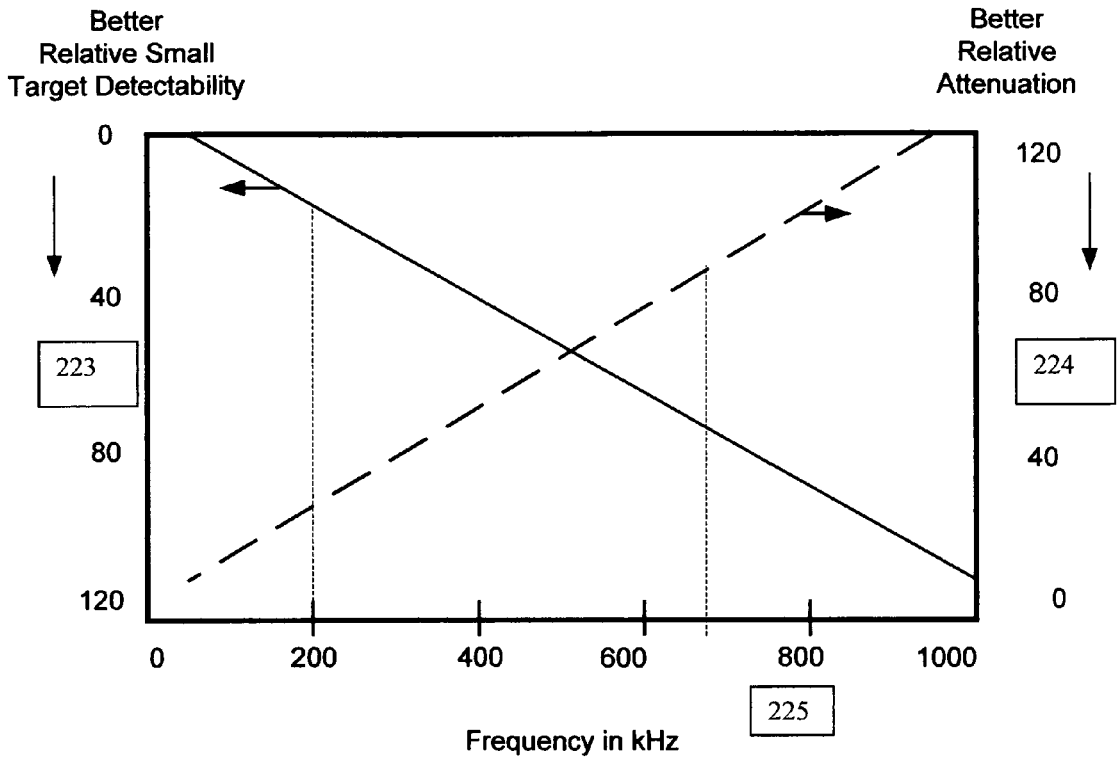

This simplified model shows general trends but does not consider the fact that low ultrasonic attenuation windows are frequently available in the broad spectrum as functions of waveguide dimensions, geometry and material properties.

e.g. General Electric Patent "Ultrasonic Waveguide" 5,289,436, 2/22/1994, Terhune, James H. referenced in Provisional Patent Application 60/549514, 3/02/2004, Wolfe, Michael. L.

Active Ultrasonic Surveillance in Shallow Water, with Echoes from the Drain Cover, Water level, a Standard Target and a Hand.
Comparator Gates are also generated, in the No-Go Zone Close to the Drain, that would Trigger the Pump OFF Command when necessary.

Case 1

Case 2

Case 3

Fig. 9D Cause and Effect Algorithm for Table 2
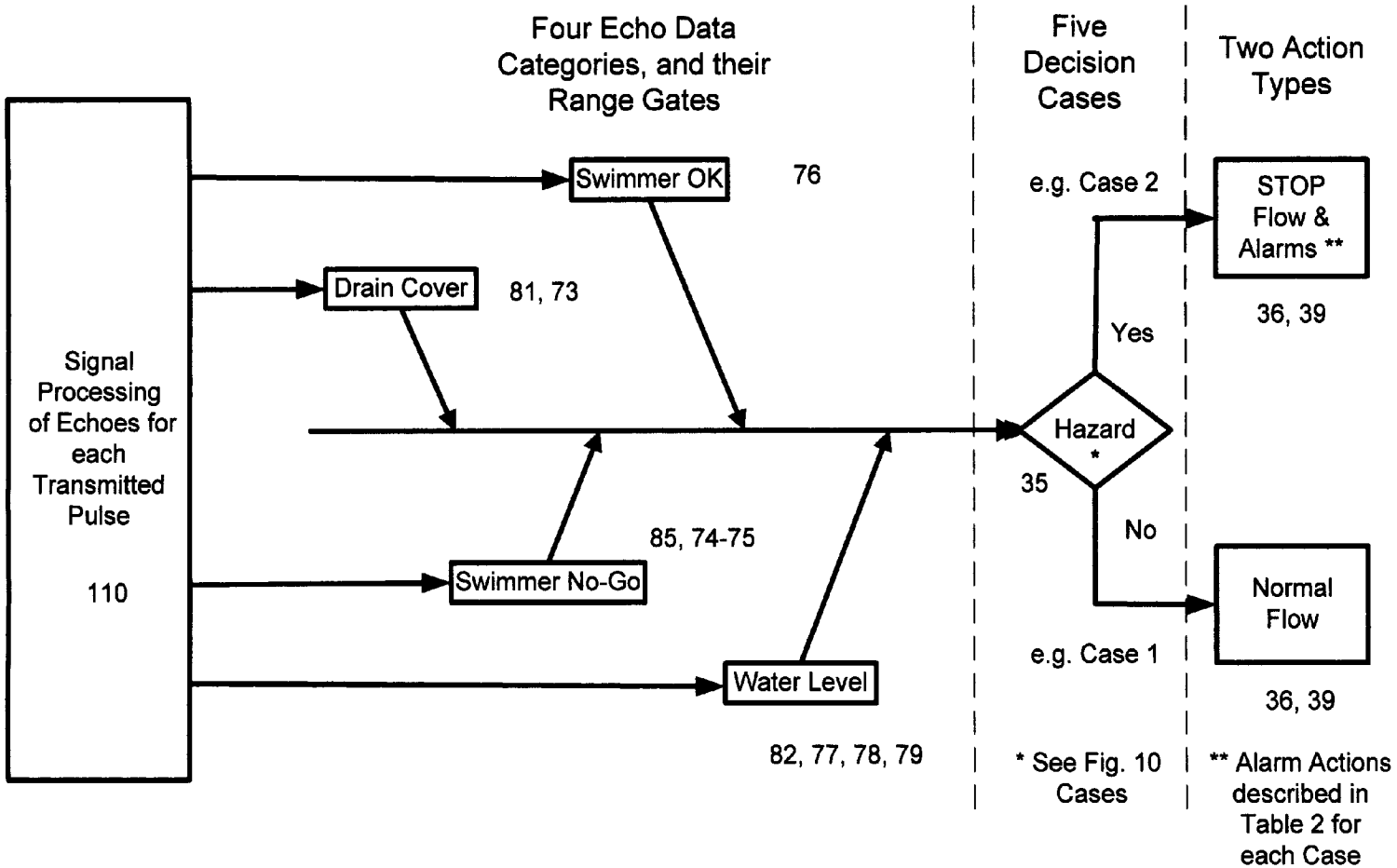

Table 2

Decision Criteria and Logic Algorithm for Flow Control of Pool, et al, Circulation Systems

| Decision Criteria: -Echo Types -Hazard Decisions -Actions | Case 1 | Case 2 | Case 4 | Case 5 | Case 6 |
|---|---|---|---|---|---|
| 1. Drain Cover Echo | Yes | Yes | NO | Yes | Yes |
| 2. Swimmer in NO-GO Range Gate Echo | No | YES | Don't care | No | No |
| 3. Swimmer in OK Range Gate Echo | Don't care | Don't care | Don't care | No | Yes |
| 4. Water Level or Wall Echo | Yes | Don't care | Don't care | NO | Don't care |
| Hazard Decision | None<br><br>Swimmer near surface,<br><br>Normal Condition | YES | YES<br><br>Extreme Danger<br><br>Immediate STOP FLOW Required | YES<br><br>If persists for more than a few seconds it can be an object on drain cover, or equipment problem, or very low water level. | None<br><br>Swimmer blocks surface echo,<br><br>Normal Condition |
| Flow Control Action<br><br>Other Actions<br><br>Alarms | Normal Flow | STOP FLOW for several seconds.<br><br>Monitor for swimmer echo and restart when clear.<br><br>ALARM if no restart allowed | STOP FLOW<br><br>NO AUTO Restart<br><br>START ALARM | STOP FLOW<br><br>NO AUTO Restart<br><br>START ALARM | Normal Flow |

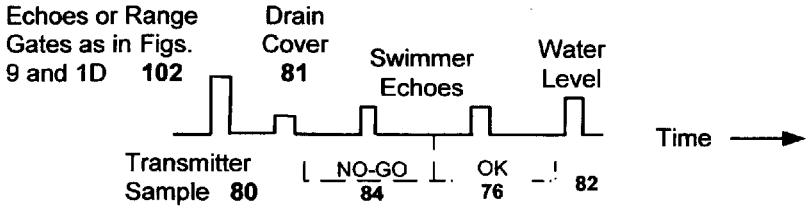

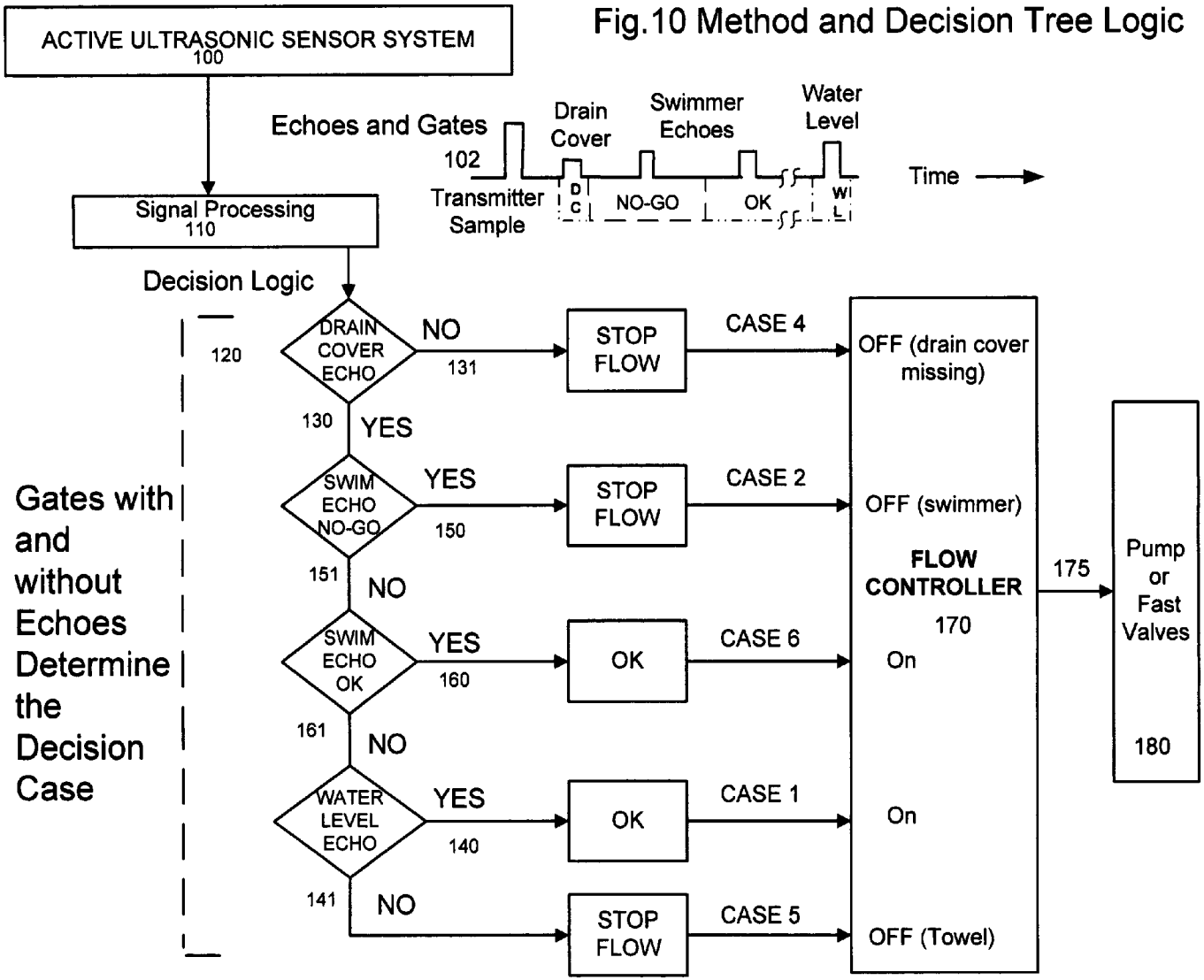
Fig.10 Method and Decision Tree Logic

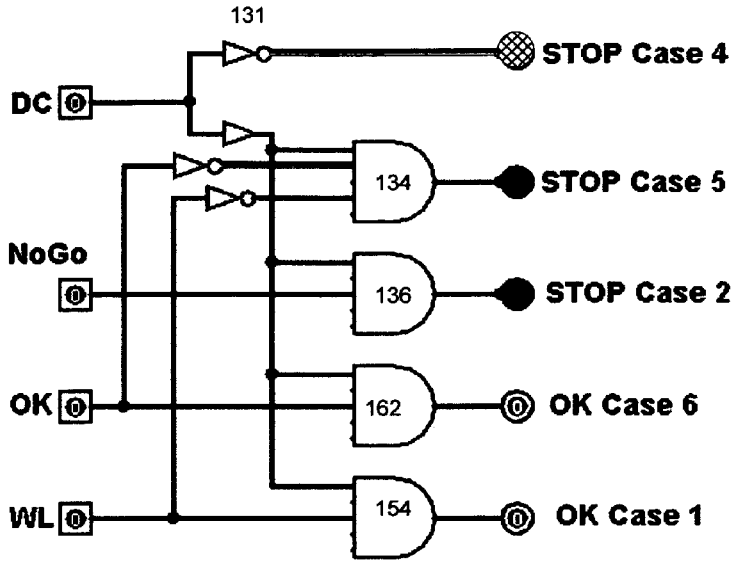
Fig. 10A Method and Decision Tree Logic Schematic (Case 4)
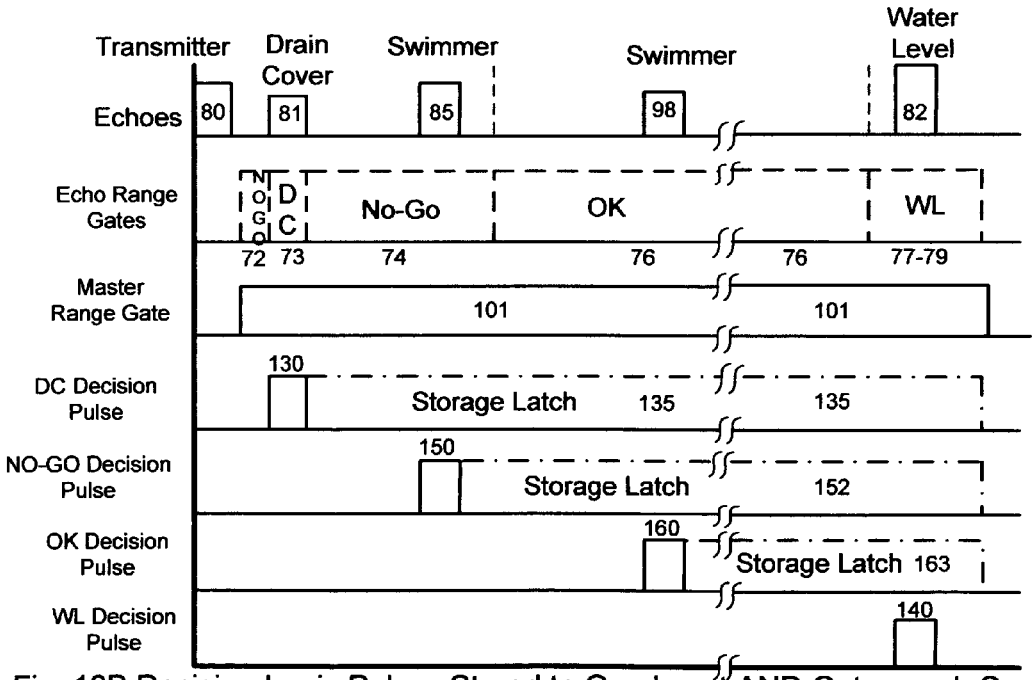
Fig. 10B Decision Logic Pulses Stored to Overlap at AND Gates each Scan (note: all key echoes are shown for explanation, but if a No-Go echo is present the STOP decision is immediate; then the OK and WL data is defined as "don't care")

Flow Controller 170 Fig.11
Pump Normally OFF:
Set ON by Sensor with Decision Logic for Cases 1 or 6
Turned OFF by Sensor with Decision Logic for Cases 2, 4, or 5
Note: Flow Controller Inputs as shown in Fig. 10
Decision Logic outputs
Pump turn ON Output Command Logic Definition for this OR gate: 1 = Pump ON
0 = Pump OFF
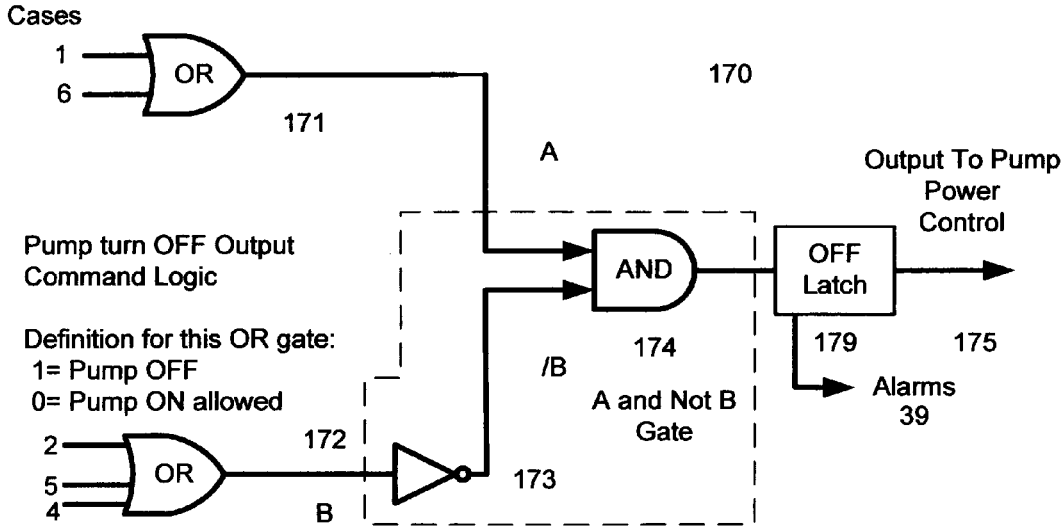
| A | B | Required Output | |
|---|---|---|---|
| 0 | 0 | 0 | OFF |
| 1 | 0 | 1 | ON |
| 0 | 1 | 0 | OFF |
| 1 | 1 | 0 | OFF |
176

59
42
45 degrees
SECTION SIDE VIEW 27
14
16
12
57
41
SECTION SIDE VIEW
TOP VIEW COVER CUTAWAY
12
41
14

10
11
20
27
16
42
57
58
40
56
20c
43
12
To Pump Suction Inlet
53
42

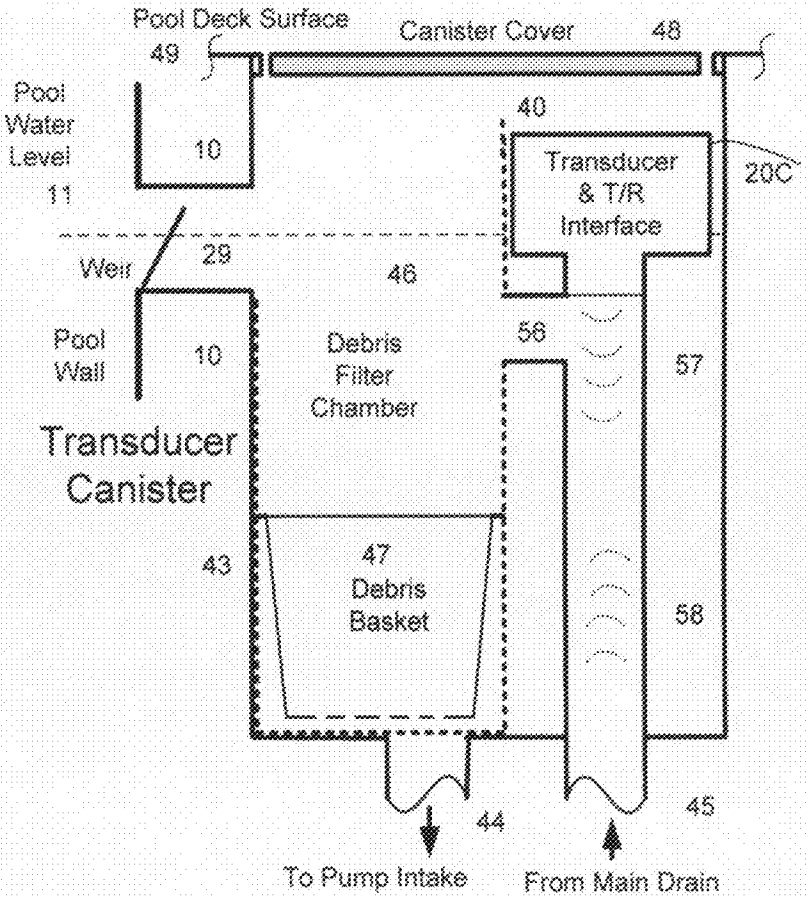
Fig. 13B Transducer Deck Canister combined with Skimmer Detail Section View
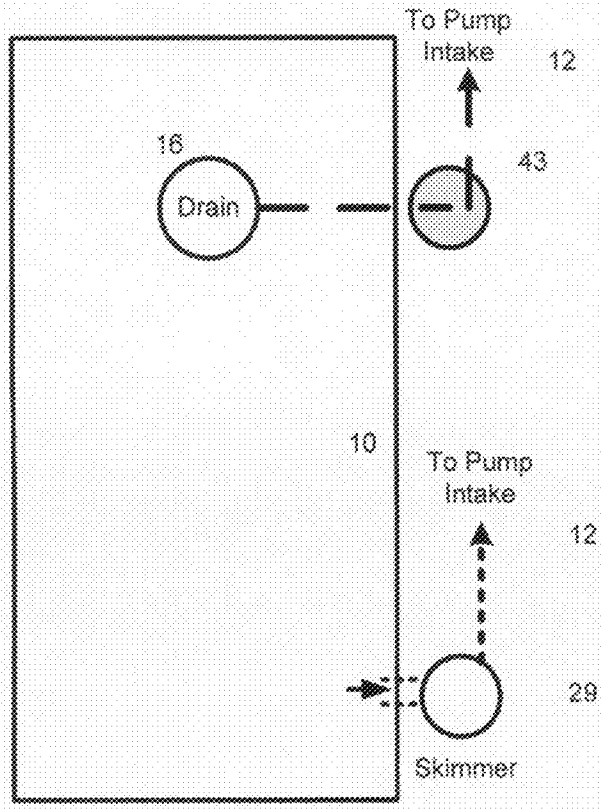
Swimming Pool Top View
Fig. 13A Fig. 14A Pool Shell Section
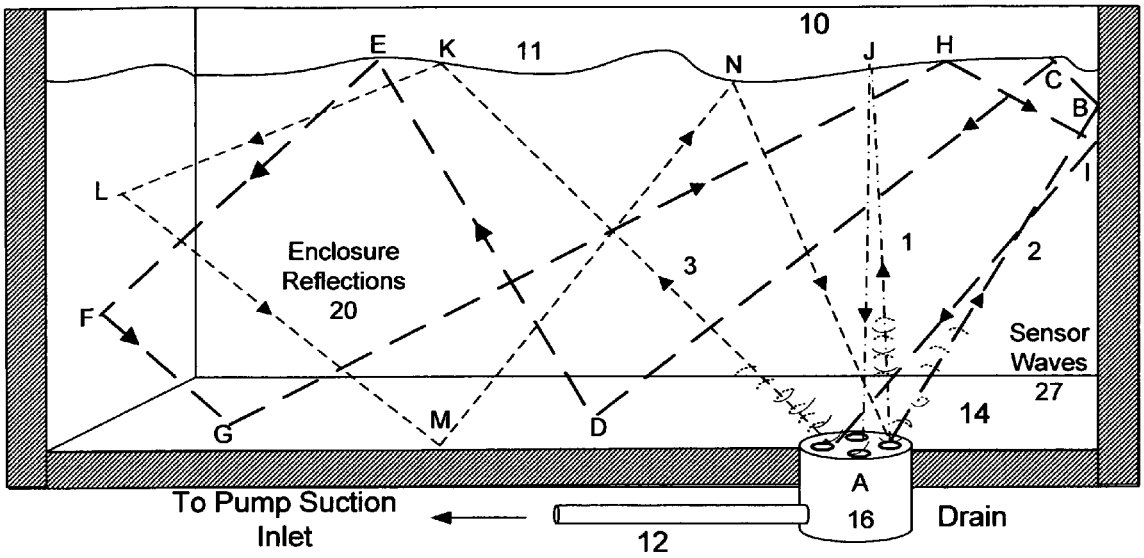
Pool Shell Section 13 non-swimmer fell in
Fig. 14B
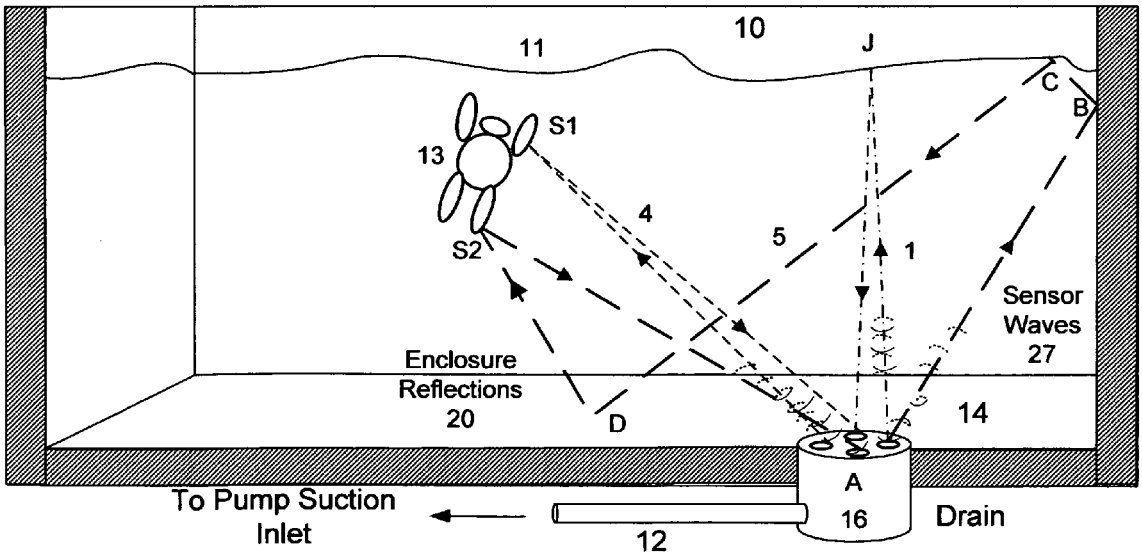

Fig. 14C Cause and Effect Algorithm for Table 3 Pool Alarm Mode
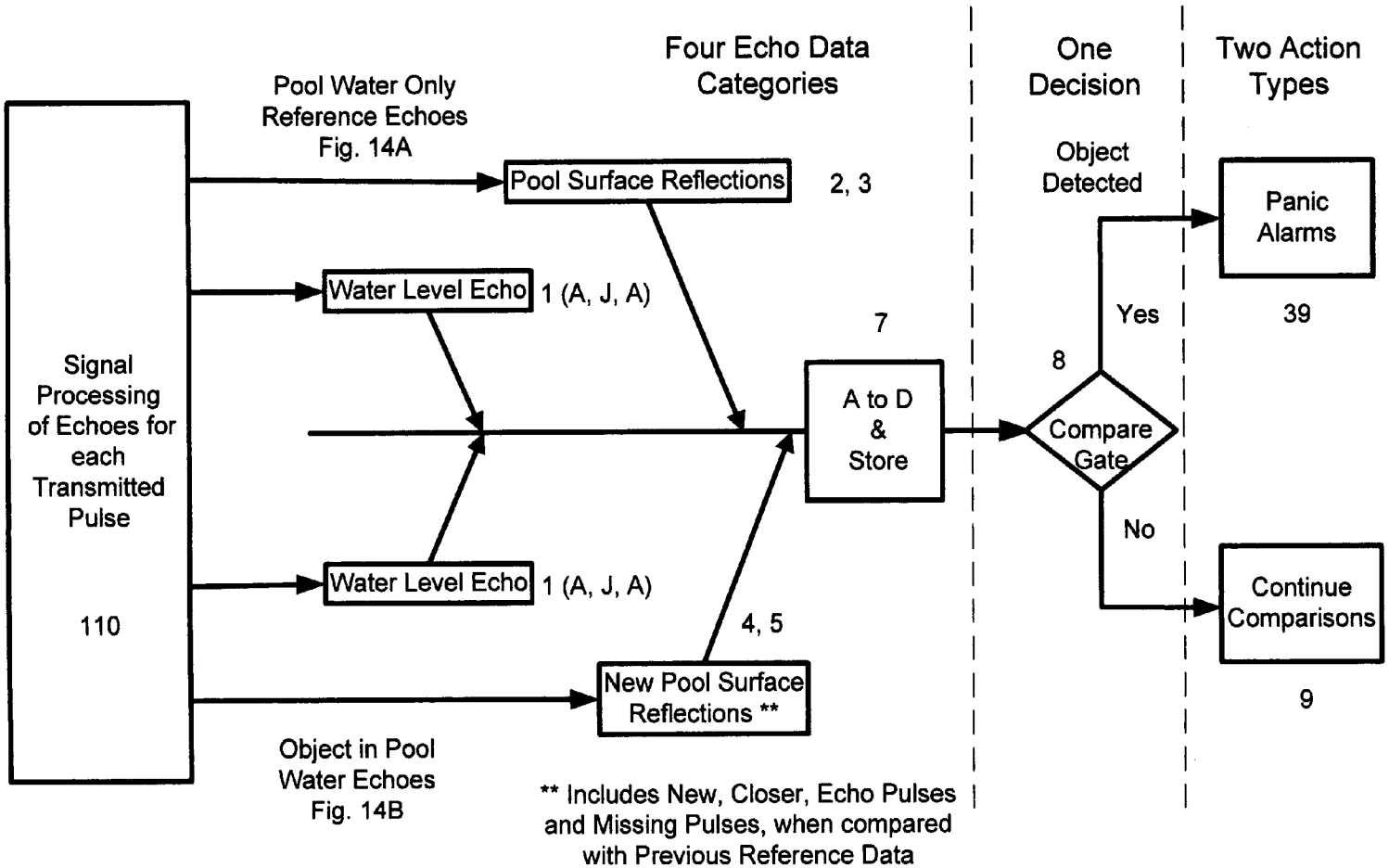

Table 3 Pool Alarm Algorithm and Model: based on Fig. 14 A and B

| **Ray Segment** Fig. 14A | Scale Length in inches | Scaled Distance 0.5 inch per foot | **Cumulative Distance in feet** | Scaled Time 0.2ms per foot one way | **Cumulative Time in milliseconds (ms)** |
|---|---|---|---|---|---|
| **Ray #1** | | | | | |
| **A-J** | 2.5 | 5.0 | 5.0 | 1.0 | 1.0 |
| **J-A** | 2.5 | 5.0 | **10.0 feet** | 1.0 | **2.0 ms** |
| | | | | | |
| **Ray #2** | | | | | |
| **A-B** | 2.625 | 5.25 | 5.25 | 1.05 | 1.05 |
| **B-C** | 0.375 | 0.75 | 6.0 | 0.15 | 1.2 |
| **C-D** | 3.875 | 7.75 | 13.75 | 1.55 | 2.75 |
| **D-E** | 2.8125 | 5.625 | 19.375 | 1.125 | 3.875 |
| **E-F** | 2.5 | 5.0 | 24.375 | 1.0 | 4.875 |
| **F-G** | 1.125 | 2.25 | 26.625 | 0.45 | 5.325 |
| **G-H** | 5.3125 | 10.625 | 37.25 | 2.125 | 7.45 |
| **H-I** | 1.125 | 2.25 | 39.5 | 0.45 | 7.9 |
| **I-A** | 2.5 | 5.0 | **44.5 feet** | 1.0 | **8.9 ms** |
| | | | | | |
| **Ray #3** | | | | | |
| **A-K** | 3.75 | 7.5 | 7.5 | 1.5 | 1.5 |
| **K-L** | 2.375 | 4.75 | 12.25 | 0.95 | 2.45 |
| **L-M** | 2.75 | 5.5 | 17.75 | 1.1 | 3.55 |
| **M-N** | 3.125 | 6.25 | 24.0 | 1.25 | 4.8 |
| **N-A** | 2.5 | 5.0 | **29.0 feet** | 1.0 | **5.8 ms** |
| **Fig.14B non-swimmer Echo Rays** | | | | | |
| **Ray #1** | | | | | |
| **A-J** | 2.5 | 5.0 | 5.0 | 1.0 | 1.0 |
| **J-A** | 2.5 | 5.0 | **10.0 feet** | 1.0 | **2.0 ms** |
| | | | | | |
| **Ray #4** | | | | | |
| **A-S1** | 3.0 | 6.0 | 6.0 | 1.2 | 1.2 |
| **S1-A** | 3.0 | 6.0 | **12.0 feet** | 1.2 | **2.4 ms** |
| | | | | | |
| **Ray #5** | | | | | |
| **A-B** | 2.625 | 5.25 | 5.25 | 1.05 | 1.05 |
| **B-C** | 0.375 | 0.75 | 6.0 | 0.15 | 1.20 |
| **C-D** | 3.875 | 7.75 | 13.75 | 1.55 | 2.75 |
| **D-S2** | 1.438 | 2.875 | 16.625 | 0.575 | 3.325 |
| **S2-A** | 2.875 | 5.75 | **22.375 feet** | 1.15 | **4.475 ms** |

Fig. 15 A
(per Table 3, and Fig. 14 A)
No Swimmer in pool, Reference Pattern
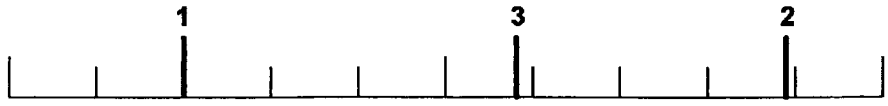
| | | | | | | | | | | | |
|---|---|---|---|---|---|---|---|---|---|---|---|
| Cumulative Time in ms. | 0 | 1 | 2 | 3 | 4 | 5 | 6 | 7 | 8 | 9 | 10 |
| Cumulative Distance, feet | 0 | 5 | 10 | 15 | 20 | 25 | 30 | 35 | 40 | 45 | 50 |
* is new echo X is missing echo
Fig. 15 B
(per Table 3, and Fig. 14 B)
Non-swimmer or object fell-in pool, Pattern Changed
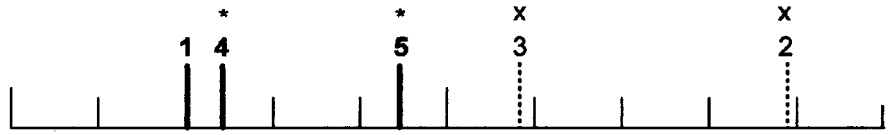
| | | | | | | | | | | | |
|---|---|---|---|---|---|---|---|---|---|---|---|
| Cumulative Time in ms. | 0 | 1 | 2 | 3 | 4 | 5 | 6 | 7 | 8 | 9 | 10 |
| Cumulative Distance, feet | 0 | 5 | 10 | 15 | 20 | 25 | 30 | 35 | 40 | 45 | 50 |
Fig.15 Pool Alarm Mode Reflections and Echoes
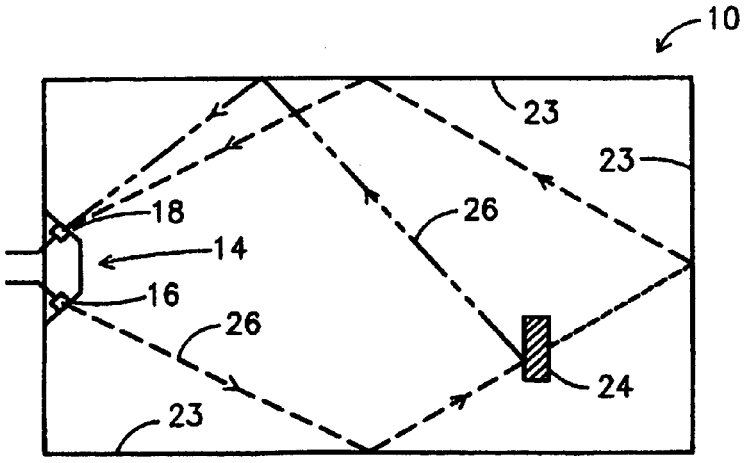
Prior Art
Fig. 15C

MACHINE AND METHOD FOR PROACTIVE SENSING AND INTERVENTION TO PRECLUDE SWIMMER ENTRAPMENT, ENTANGLEMENT OR EVISCERATION

This is a Continuation-in-Part of an earlier application Ser. No. 11/069,332, filed Mar. 1, 2005 now abandoned and incorporated by reference in it's entirety.

CROSS REFERENCE TO RELATED APPLICATIONS

Not Applicable

FEDERALLY SPONSORED RESEARCH OR DEVELOPMENT

Not Applicable

DESCRIPTION OF ATTACHED APPENDIX

Not Applicable

BACKGROUND

1. Field of the Invention

This invention relates generally to the field of Swimmer Entrapment Avoidance, and more specifically to the means for precluding swimmer entrapment, entanglement or evisceration due to suction drains in swimming pools, spas, and the like; with a hydraulically independent sensor that anticipates a user's danger.

2. Description of Prior Art

The Consumer Product Safety Commission (CPSC) has reported over many years that there are dozens of deaths and grave injuries each year in the US, mostly young children, due to the suction entrapment hazards of swimming pools, wading pools and spas. The CPSC has recently set up testing facilities for Safety Vacuum Release Systems (SVRS); products now on the market intended to rapidly reduce suction and release an entrapped person.

All SVRS devices now sense an increase in suction, near the pump inlet, that occurs when a person blocks all or a major part of a remote suction drain. None can anticipate the event, and that is a serious flaw in swimmer protection.

Thus, the prior art is only capable of catch and release; not really avoidance, as specified in ANSI/APSP-7 2006, Standard for Suction Entrapment Avoidance in Swimming Pools, Wading Pools, Spas, Hot Tubs, and Catch Basins.

The potential and actual hazards due to underwater suction drains include evisceration that can occur in a fraction of a second, if the drain cover is missing; hair entanglement, and limb, body, or mechanical entrapment, all as defined in ANSI/APSP-7 2006.

In addition to the tragic results mentioned there are large societal costs related to long term medical treatment of the injured, major awards and expenses of litigation, inhibiting business activity, and reducing opportunity for the public to enjoy the fitness, health and recreation benefits of safe water facilities whether public or private.

The main problem with conventional entrapment avoidance sensors is that they are constrained to allow a very significant increase in the suction, due to actual entrapment, before taking corrective action. This allows a potential victim to approach the drain closely without a significant increase in the suction being sensed. Only when the suction port is mostly blocked by the victims body or limb does a large increase in suction suddenly occur. Under these conditions a small child may be partially or totally eviscerated in an extremely short period of time. Some tests reported in the literature indicate that damage can be done within a small fraction of a second, when the short distance to complete the drain sealing is covered and a very high degree of vacuum is thereby allowed to occur momentarily. Furthermore, hair entanglement occurs without a major increase in suction at all.

When a deep pool drain cover is damaged or missing, a lethal hazard for limb or body entrapment is created. A missing drain cover is also an invitation to limb entrapment because instant swelling of arm tissues under the pipe vacuum condition may not allow extrication even if an SVRS does function as expected.

In a shallow pool, as at children's wading pools, a damaged or missing drain cover creates a lethal hazard for drowning or evisceration. No SVRS can sense that condition and take protective action prior to an entrapment.

Hair entanglement in a drain cover happens very quickly; and is also not likely to trigger an SVRS. Fatalities have occurred in this manner.

Some other prior art deficiencies may be summarized as follows:

- Present SVRS also have a major weakness in terms of field reliability over years of time with no requirements for periodic, automatic calibration, testing, and traceability of such tests.

Experience with outdoor installations shows that there are three primary hazards to safety and control system reliable operation:

- Lightning and induced power surge damage occurs rapidly and can easily go undetected without frequent testing.
- Corrosion is slow but steady, and reliability is unpredictable without frequent testing.
- Lack of self calibration and self test capability.

Furthermore, all SVRS devices are hydraulically dependent sensors, so that changing flow circulation conditions due to poor filter maintenance, pump speed changes, changes in valve settings, cleaning system variables, dual drains with one blocked, etc. can have a serious effect upon the suction sensor functioning properly when it must. Additionally, fail-safe principles in design, fabrication and installation are not applied in any systematic, verifiable, way in these SVRS devices.

Prior Art Patents

A few single purpose pump suction sensor and shut-down devices and systems have also been brought to market such as: Stingl Switch, U.S. Pat. No. 6,059,536, Stingl, May 9, 2000; and Influent Blockage Detection System, U.S. Pat. No. 6,342,841, January 2002, Stingl. These are expensive single purpose devices marketed primarily to municipal and large club pools.

Also, Fluid Vacuum Safety Device for Fluid Transfer Systems in Swimming Pools, U.S. Pat. No. 5,947,700, September 1999, McKain et al; and Spa Pressure Sensing System Capable of Entrapment Detection, U.S. Pat. No. 6,227,808, May 2001, McDonough.

Several other patents describe very specific capability for a single purpose using novel sensors. For example: Pump Shut-off System, U.S. Pat. No. 6,039,543, March 2000, Littleton; describes a flow switch and control circuit to shut-down a pump when there is insufficient fluid flow and pump damage may result. Also, Pool Pump Controller, U.S. Pat. No. 5,725,359, March 1998, Dongo et al; does address swimmer safety regarding suction entrapment in a pool drain, by means of a novel diaphragm switch that removes power from the pool pump when a certain change in fluid pressure (unspecified) occurs.

Suction safety requires fast, sure removal of the entrapment force, severely limiting both the magnitude and duration of that force. Hair entanglement hazards are possibly quite sensitive to the duration of the suction force as well. Stingl, U.S. Pat. No. 6,342,841 asserts "there is no need to "relieve" residual vacuum in the line because water is not compressible".

A patent by Wolfe U.S. Pat. No. 6,676,831, January 2004 asserts, however, that there is a very significant increase in the total impulse (force×time) causing entrapment of a person. Recent data from an actual pool installation with that prior invention showed a small increase in peak force of 12.3%, but accompanied by a large increase in the action time. The total time of significant entrapment force, as measured from the beginning of a measured rise in suction to when the shutdown returned suction to its beginning level was:

With suction dump valve: 0.417 seconds

Without suction dump: 1.503 seconds

This is a ratio of 3.6 to 1. Multiplying the force and time ratios we find that the overall entrapment impulse is four times greater if we do not "relieve" the suction with a vent to atmospheric pressure. The explanation for this situation may be related to the fact that the suction water column and pump impeller momentum does not instantly disappear when power is shutoff, but dissipates over a time period of 1.5 seconds. In the above discussion, just as in the cited patent, the measured suction was at or near the pump inlet port. Furthermore, if we examine the ratio of entrapment or entanglement time starting from when the pump is shutoff we find that:

Time from Shutoff to Atmospheric Pressure:

With Suction Dump Valve: 0.08 seconds

Without Suction Dump: approximately 4 seconds

This is considered to be reason enough to include suction relief by using a properly configured dump valve. The cited patent also describes a "safe level of vacuum as 11 in.Hg.". This level of vacuum is considered too high by several authorities, especially if prolonged action time is involved. The Wolfe patent also accounts for the minor variations present in pools with in floor cleaning systems and solar heating, but typically operates at a shut-down threshold of 8 in.Hg. Wolfe, U.S. Pat. No. 6,676,831, however, is intended primarily for residential pools and spas and is a combination with several safety and convenience functions but still contends with most of the deficiencies found in all SVRS devices with concomitant risks to swimmers as described above.

Another U.S. Pat. No. 5,947,700, September 1999, McKain et al, describes an alternative embodiment of a suction entrapment release device, and mentions that the "ideal vacuum pressure at which the frangible member disintegrates is approximately 20 in. Hg." This value is considered extraordinarily high as a safe limit. In fact, it is questionable as to whether it could be reliably achieved at the location shown, near the input to the pump, because of the presence of the second suction line from the pool.

Problems Solved by the Invention

The sensor and control system according to the present invention substantially departs from the conventional concepts and designs of the prior art, and in so doing provides an apparatus and method primarily developed for the purpose of a complete solution to the suction drain entrapment, entanglement, or evisceration hazards found in most swimming pools, wading pools, spas, hot tubs, and the like. When a pool drain cover is damaged or missing a major hazard for limb or body entrapment, and even evisceration, exists. The ability of this invention to sense a missing drain cover is unique and can be used to shutdown the circulation system and generate alarms as required by the ANSI/APSP Standard. The capability for short range swimmer detection is unique and extremely valuable because prevention of entrapment has been shown to be much safer than release of entrapment after it occurs. This is particularly true for situations leading to evisceration or hair entanglement.

This unique capability is achieved by means of a sensor that can anticipate the developing hazard of a swimmer approaching too closely, or too rapidly, to a suction drain. All forms of potential hazard are thereby mitigated and precluded by control actions taking place before hazardous contact can occur.

With the present invention we can be assured that the drain cover is in place. This is a major benefit because missing drain covers have produced horrendous permanent injuries and drownings.

This invention deals with both retrofit and new construction; although there are obviously more embodiment options available for new construction. It is estimated that there are at least 5 million old swimming pools in the US that can feasibly be retrofitted with the present invention. Moreover, it is precisely these old pools that are the most hazardous because they do not have the other safety features such as anti-entrapment, anti-entanglement drain covers, dual main drains, vents, or SVRS devices that are now increasingly found on new pools. Old pools may also have been upgraded with higher power pumps that present a stronger suction hazard.

The main problem with conventional entrapment avoidance sensors are that they cannot anticipate the dangerous level of suction which will occur with full drain blockage until it occurs. The subject invention directly senses and measures the approach of a person or other object to the drain before significant blockage can occur. This anticipation by the subject invention is due to sensing distance from the drain rather than the consequences of a person blocking a drain. Only an active sensor operating at close range from within the drain system can reliably detect and prevent all five major forms of drain entrapment as defined by the CPSC, and in the ANSI/APSP-7 Standard.

Objects and Advantages

The primary object of the invention is to preclude Entrapment which comprises all of the hazards of evisceration, hair entanglement, limb entrapment, body entrapment, and mechanical as defined by ANSI/APSP-7 2006.

Another object of the invention is to provide a means of detecting the required presence of the drain cover, the absence of which creates a lethal hazard. A missing drain cover requires immediate pump shutdown and no existing SVRS system can detect this situation.

Another object of the invention is provide a means of anticipating a potential swimmer entrapment situation as at a swimming pool or spa drain.

An object of the present invention is to provide an active ultrasonic sensor that implements anticipatory sensing, intervention, and alarms when flow control intervention occurs.

A further object of this invention is to provide swimmer protection wherein the occurrence of a potentially or actually hazardous approach to a drain is measured and will be acted upon with predetermined logic, prior to any contact or entrapment occurring.

Another object of this invention is to provide a mode of operation for the active ultrasonic sensor to detect that an object or person has fallen into a pool, at a time when no swimmers are expected to be in the pool. It is possible to detect this by various sensor modifications and/or extensions, primarily in the decision logic, control and alarms since the same transducer assembly and the in-drain location provide the pool volume coverage desired. Such detection will result in a panic alarm activation both outside and inside the premises to summon immediate assistance.

Another object of the invention is to detect masking of the water surface echo by any absorptive object that may also be treated as an alarm situation.

Yet another object of the invention is, for new construction, to optimize the suction piping network by eliminating the attenuative 90 degree elbows, using larger bend radius sweep elbows, or other controlled reflection elbows, as described herein.

Another object of the invention is a flow rate sensor. Flow is a significant parameter in the design of swimming pools and is not usually verified in the field. The sensor system can be enhanced to measure the doppler shift or Time of Flight, and thus provide a good estimate of water speed in the piping. The ANSI/ASME standards for water velocity are established to insure that the velocity is low enough to limit the magnitude of the suction hazard, and high enough for an economical pump and piping design. Additionally, low water velocity may be a symptom of a partially blocked drain or filter and can be used to alert service personnel.

A further object of the invention is the further benefit of a pool alarm, for example if a child falls into the pool, it is possible to detect this by various sensor modifications and/or extensions as described herein.

Yet another object of the invention is to provide an innovative design that is also self testing, self calibrating, and fail-safe unlike any other SVRS:

- Self Calibration of the active ultrasonic sensor by measuring the predefined distance, and presence, of the drain cover.
- Self Test of the active ultrasonic sensor by measuring the predefined distance to the water level (with a small allowance for normal variations and waves), or opposite pool wall.
- Fail-Safe design of the predetermined decision logic and flow control.

A major advantage of this invention is that it inherently operates independently of the pool circulation hydraulics, and is therefore not subject to swimmer protection failures based on variations, temporary or long term, in the suction conditions at a drain.

Still yet another object of the invention is, for new construction, locating a sensor in or under/behind each drain and the beams are easily directed perpendicular to the drain cover and beyond to the swimming area. Thus, the presence of an approaching swimmer can be detected, and tracked, to allow the pump to be shutdown prior to a dangerous physical contact. The echo produced by the swimmer closest to the drain cover cannot be blocked by any other echo originating from further away. Any other geometry for the ultrasonic source location cannot provide this advantage.

In accordance with a preferred embodiment of the invention, there is disclosed a process for anticipatory sensing and intervention to avoid swimmer entrapment, comprising the steps of:

- Providing an active suction entrapment sensor (e.g. ultrasonic) that can assess the relative hazard based on swimmer proximity to the drain cover.
- Providing predetermined decision logic for all predetermined ultrasonic echoes close to the drain, and at or near the water level, or opposite pool wall.
- Providing flow control to implement the safety actions and alarms required.

Other objects and advantages of the present invention will become apparent from the following descriptions, taken in connection with the accompanying drawings, wherein, by way of illustration and example, an embodiment of the present invention is disclosed.

SUMMARY

A method and apparatus for a proactive automatic suction drain entrapment prevention system for users of a swimming pool, wading pool, spa, or the like. An active ultrasonic surveillance sensor transmits pulses from within a drain, through the drain cover and into the water beyond. Ultrasonic echoes are received from the drain cover, the water level or wall opposite the drain, and any swimmer in close proximity to the drain, thereby anticipating an impending swimmer entrapment. These echoes are received by the ultrasonic transducer of the sensor and converted back to electronic signal form. The receiver amplifies, filters and processes the sequence of echo pulses to allow for detection, thresholding, and an automatic flow control decision in accord with predetermined criteria. Thus, if an echo is within the predetermined No-Go range criteria it is presumed to be a swimmer. A flow control OFF command is output instantly, precluding any form of entrapment, hair entanglement or evisceration. No contact with the drain cover is needed to assure swimmer safety, and the separation of a swimmer from the drain is invaluable in precluding hair entanglement or evisceration.

Additionally, since a missing drain cover is a lethal hazard requiring immediate pool shutdown and closure under ANSI/APSP-7 2006; it is constantly monitored by the ultrasonic sensor and predetermined range gates. Automatic control action is taken immediately, independent of whether swimmers are sensed; and alarms are activated. Reliability is assured by self-test and self calibration with each transmitted pulse, many times per second. Fail-safe logic and control rules cause immediate flow shutdown, with alarms, in the event of component or device failure.

Other features and benefits result from this sensor and control embodiment, and are further described in this Specification.

DRAWINGS

The drawings constitute a part of this specification and include exemplary embodiments to the invention, which may be embodied in various forms. It is to be understood that in some instances various aspects of the invention may be shown exaggerated, scaled or enlarged to facilitate an understanding of the invention.

FIG. 1A Ultrasonic sensor transmits pulses and receives echoes through the drain cover, and throughout the water beyond.

Figure 1B:
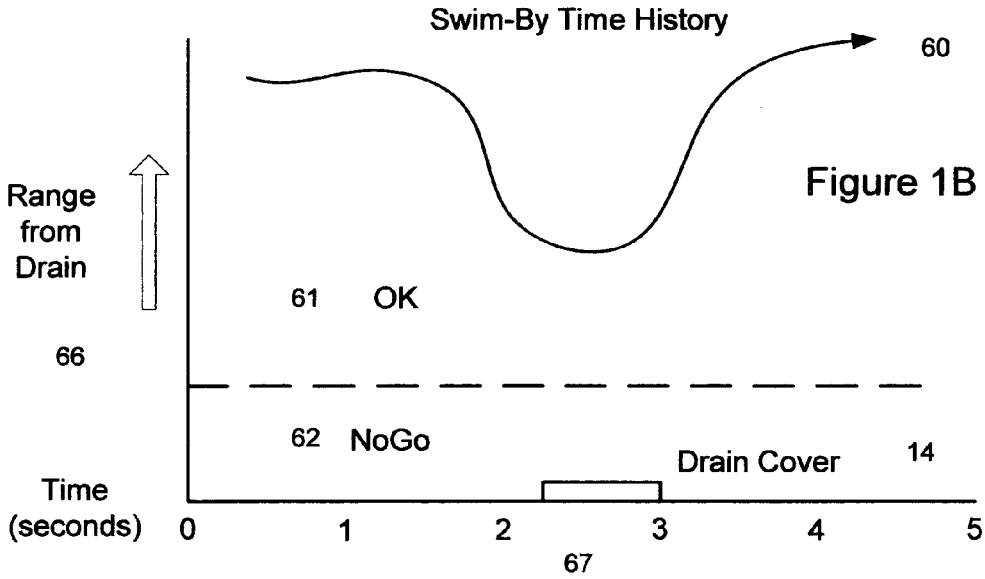

FIG. 1B Swim-by time history.

Figure 1C:
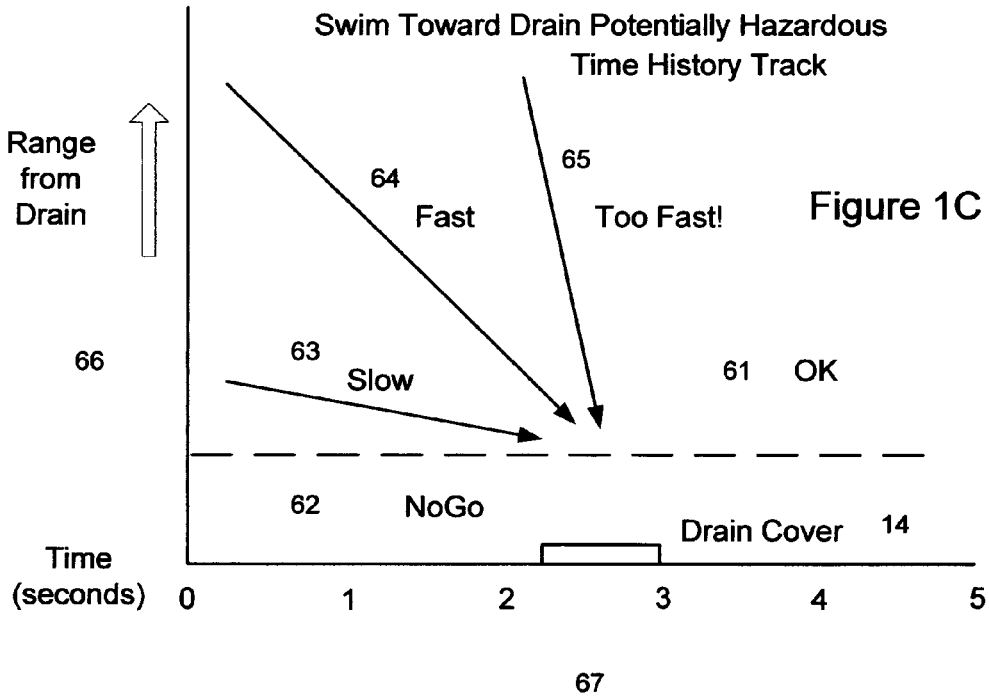

FIG. 1C Hazardous swim time history track.

Figure 1D:
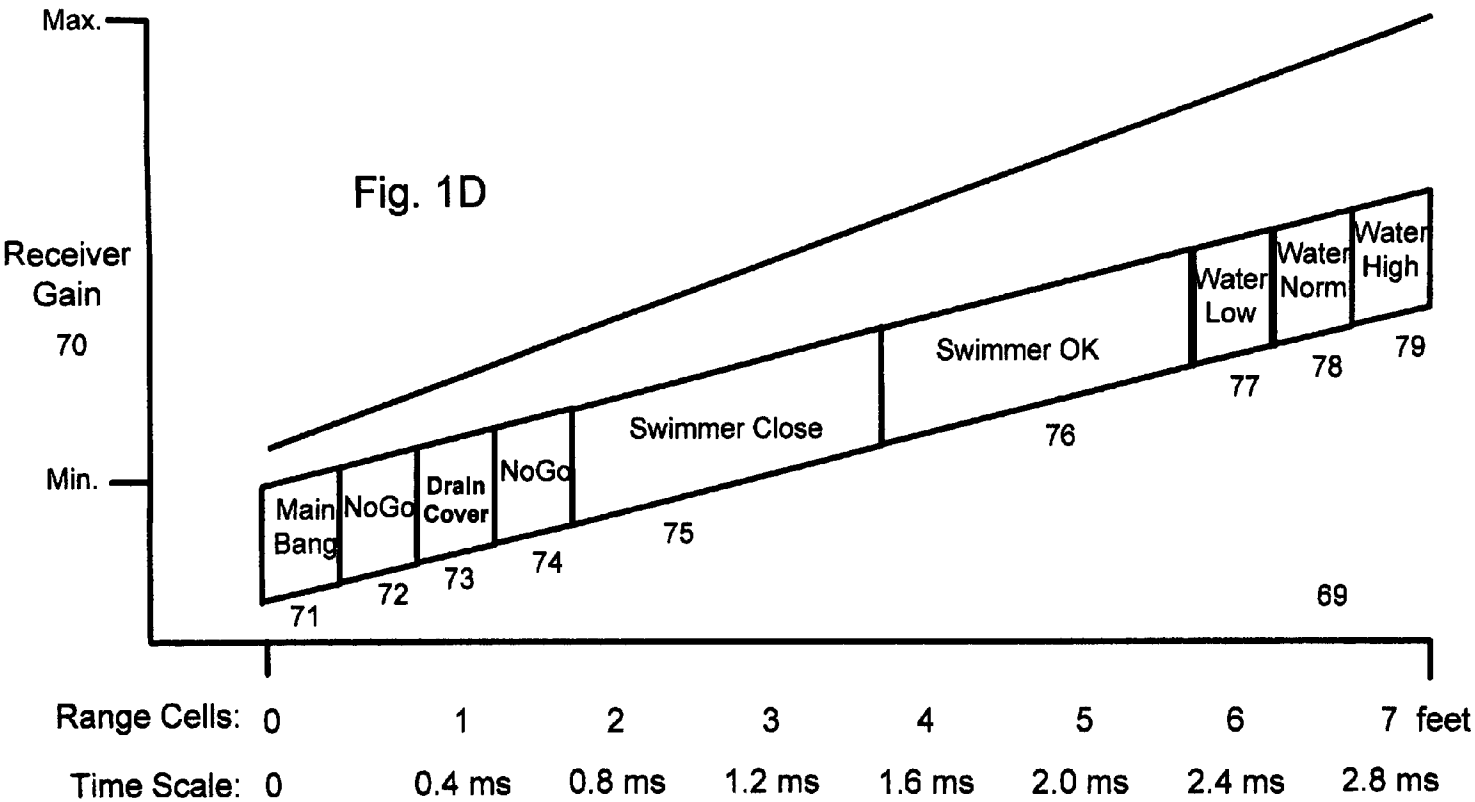

FIG. 1D Range cells are time gates.

Figure 2A:
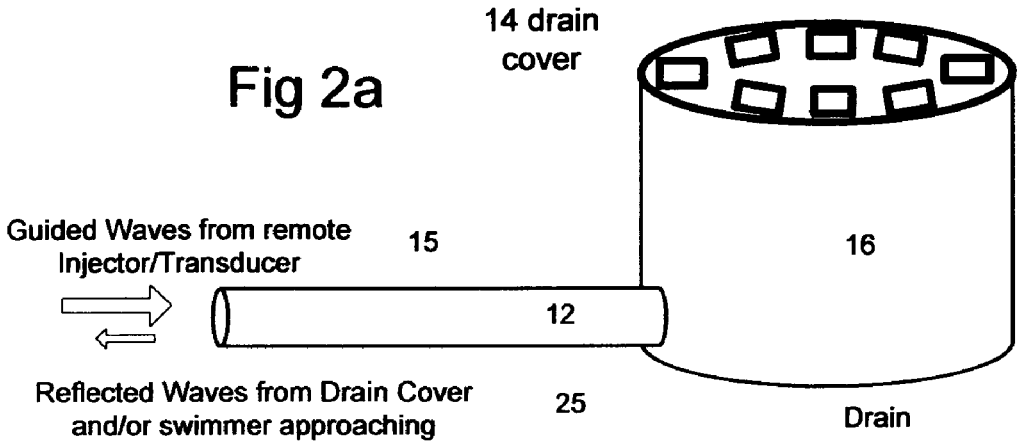

FIG. 2A Method of using pool water suction piping directly as an ultrasonic waveguide to and from the drain.

Figure 2B:
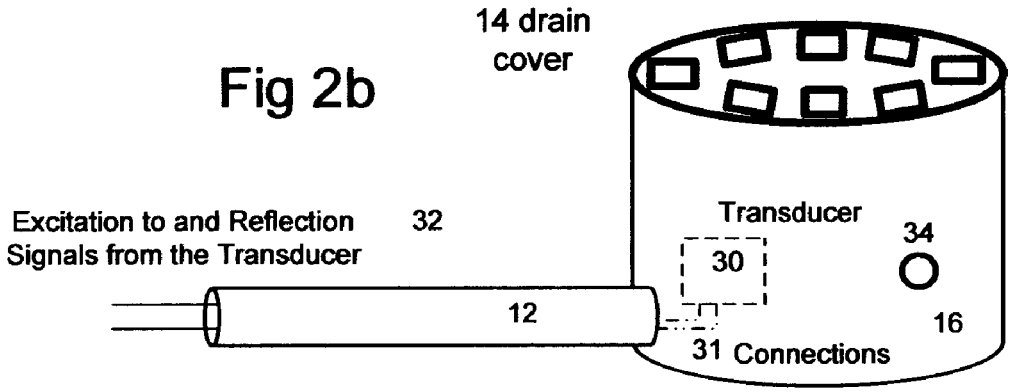

FIG. 2B Method of using pool water suction piping as a cable conduit to and from the drain.

Figure 2C:
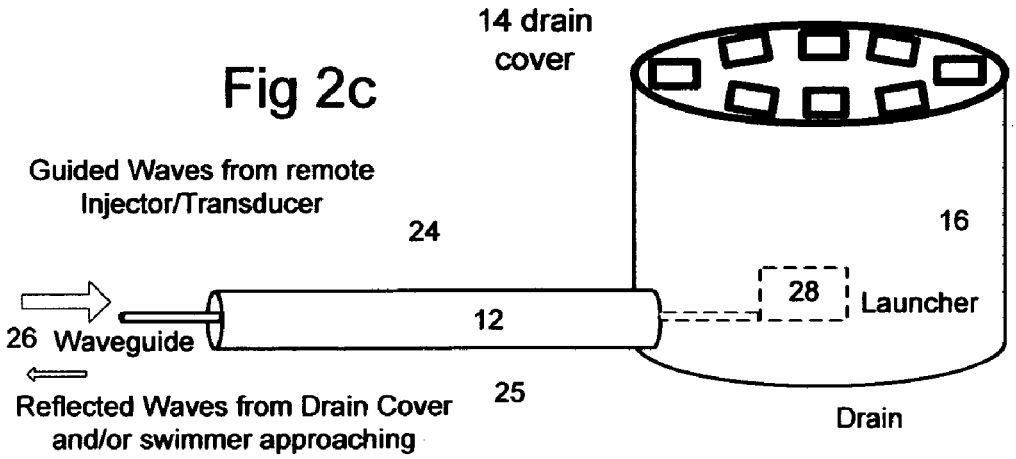

FIG. 2C Method of using pool water suction piping as a conduit for an ultrasonic waveguide to and from the drain.

FIG. 3 Ultrasonic transducer or launcher structure in a drain for new construction.

Figure 3A:
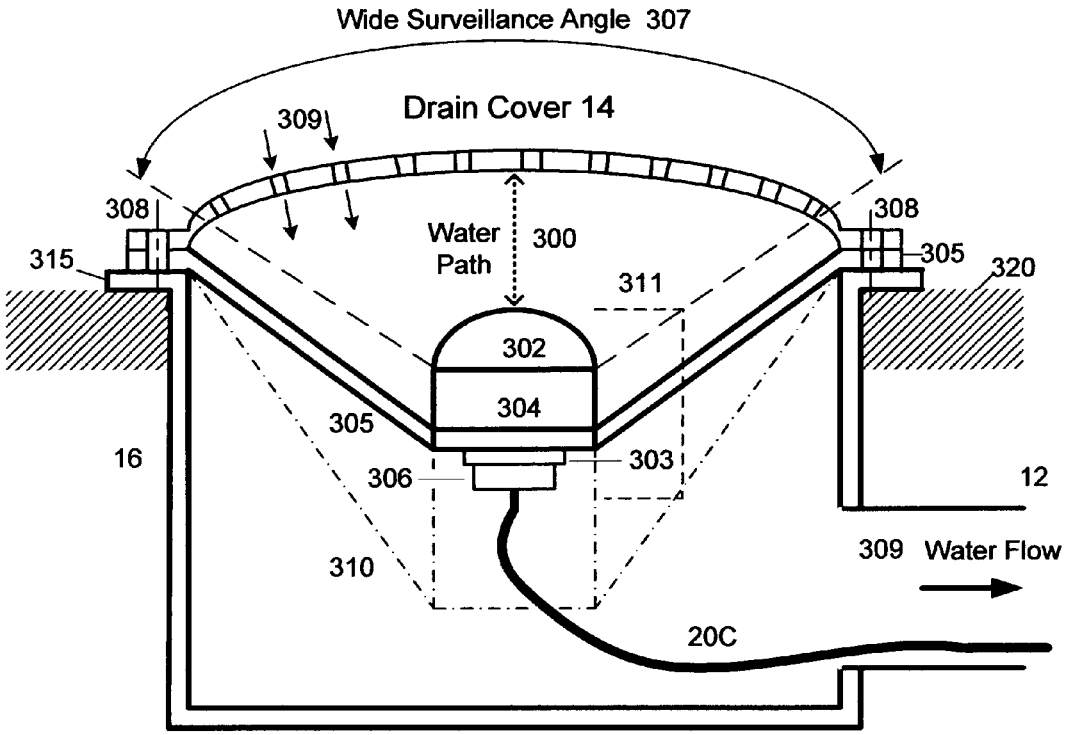

FIG. 3A Ultrasonic transducer assembly with support bracket installed in a drain.

Figure 3B:
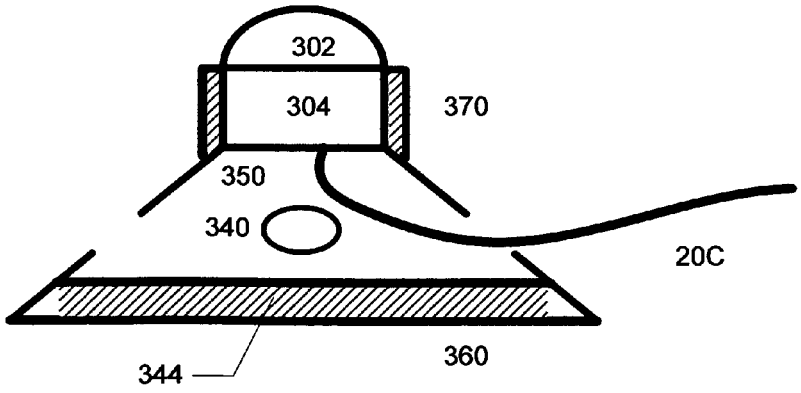

FIG. 3B Ultrasonic transducer assembly with support base as alternative for drain installation.

FIG. 3C Top View of FIG. 3A with Fastening Details

Figure 3D:
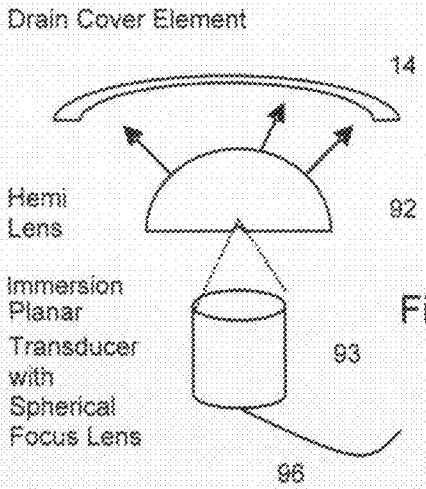

FIG. 3D, E, F Transducer and acousto-optics elements structural configurations.

Table 1 Embodiments provide hemispherical beam pattern above the drain.

FIG. 3G Planar transducer and hemispherical lens prior art.

FIG. 3H Hemispherical transducer prior art.

FIG. 4A System block diagram for remote transducer with cable connection to transmitter and receiver.

FIG. 4B System block diagram for remote launcher with waveguide connection to transmitter and receiver.

FIG. 5A, B Installation details for local transducer piping modification with connection to transmitter and receiver; or as cable port for remote transducer in drain. with connection to transmitter and receiver.

Figure 6:
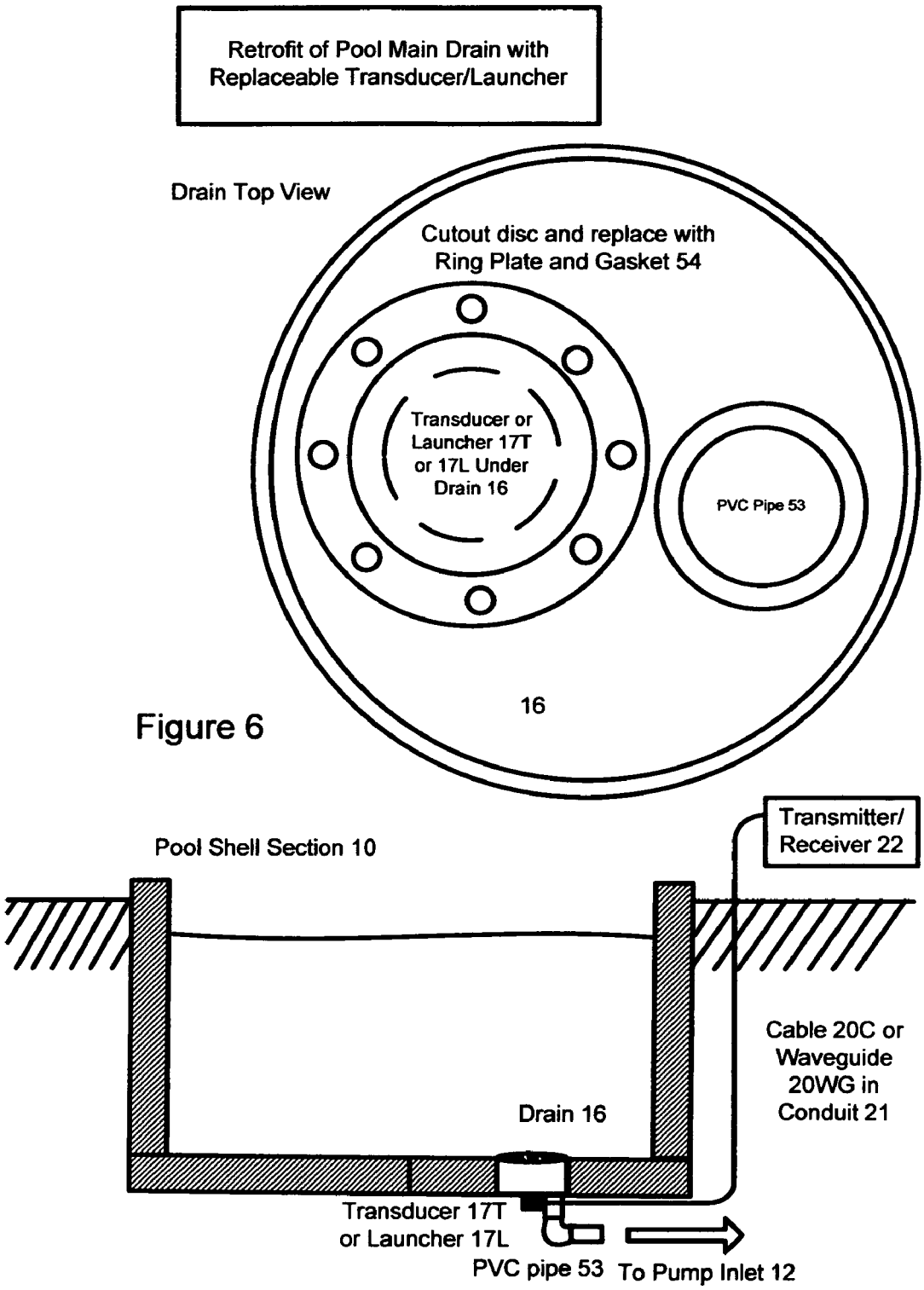

FIG. 6 Alternative for retrofit with replaceable remote transducer or launcher with connection to transmitter and receiver.

FIG. 7A-1,-2,-3 Drain cover echo tests at three frequencies.

FIG. 7B-1,-2,-3 Drain cover and hand echo tests, at 1 MHz.

FIG. 7C-1,-2,-3 Drain cover echo tests with range gates.

FIG. 8A Drain cover and hand echo with range gate, and hand echo with FFT digital signal processing.

Figure 8B:
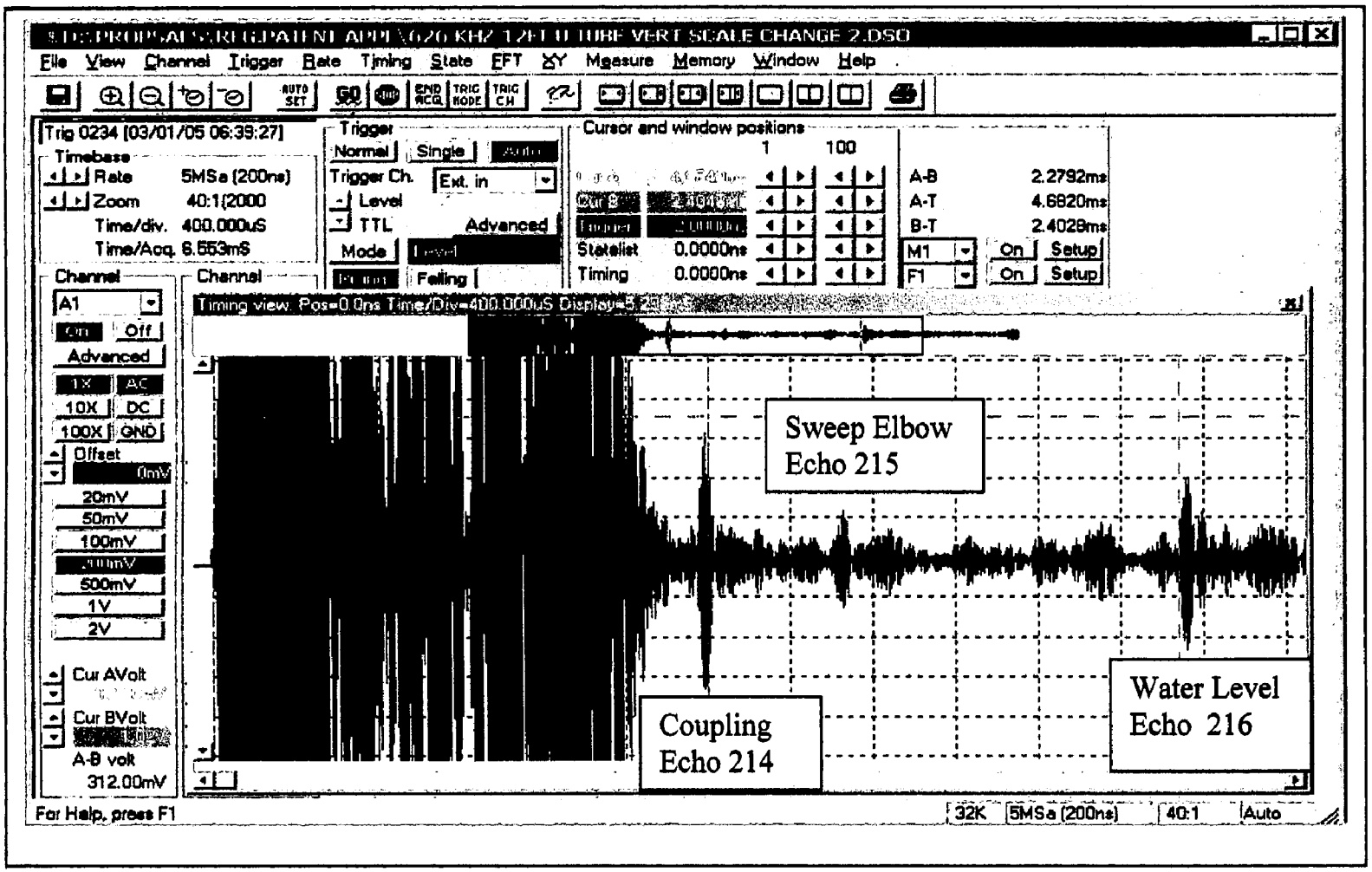

FIG. 8B Ultrasonic waveguide echo tests, 12 foot U tube, 2 inch PVC pipe, at 626 KHz.

FIG. 8C Ultrasonic waveguide echo tests, 10 foot U Tube, 2 inch PVC pipe, at 200 KHz.

FIG. 8D Ultrasonic propagation model.

Figure 9A:
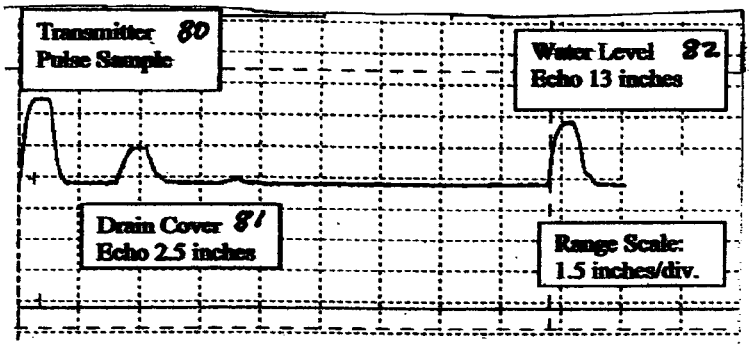

FIG. 9A Shallow water test: transmitter pulse sample, drain cover and water level echoes. (Case 1)

Figure 9B:
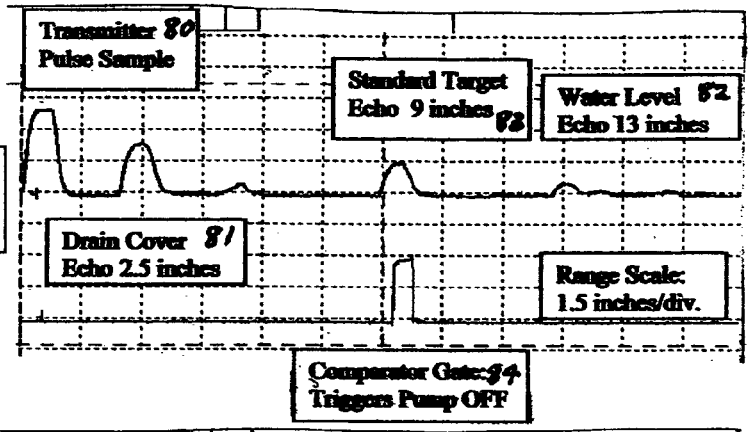

FIG. 9B Same as 9A plus standard target echo in No-Go Range Gate triggers a comparator output for Flow Control. (Case 2)

Figure 9C:
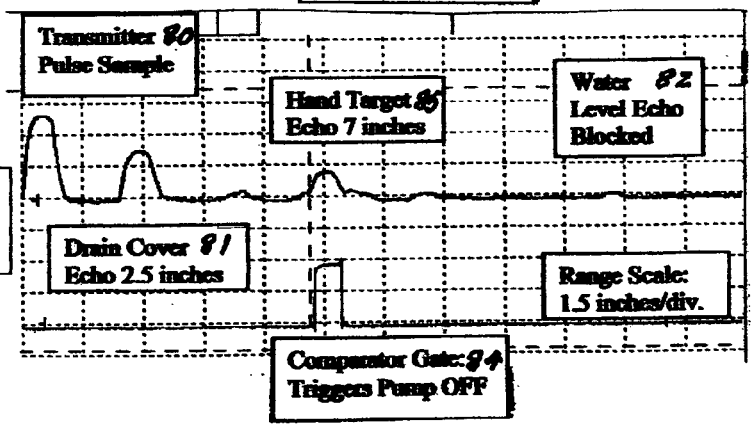

FIG. 9C Same as 9A plus hand target echo in No-Go Range Gate triggers a comparator output for Flow Control. (Case 2)

FIG. 9D Cause and Effect Algorithm for Table 2 Decision criteria and Logic.

Table 2 Decision criteria and logic Algorithm for Flow Control of suction hazard. (Cases 1-5)

FIG. 10 Method and Decision Tree Logic.

FIG. 10A Method and Decision Tree Logic Schematic (Case 4 shown)

FIG. 10B Decision Logic Pulses Stored to Overlap at AND Gates each scan.

FIG. 11 Flow Controller logic and schematic.

Figures 12A, 12B, 12C, 12D:
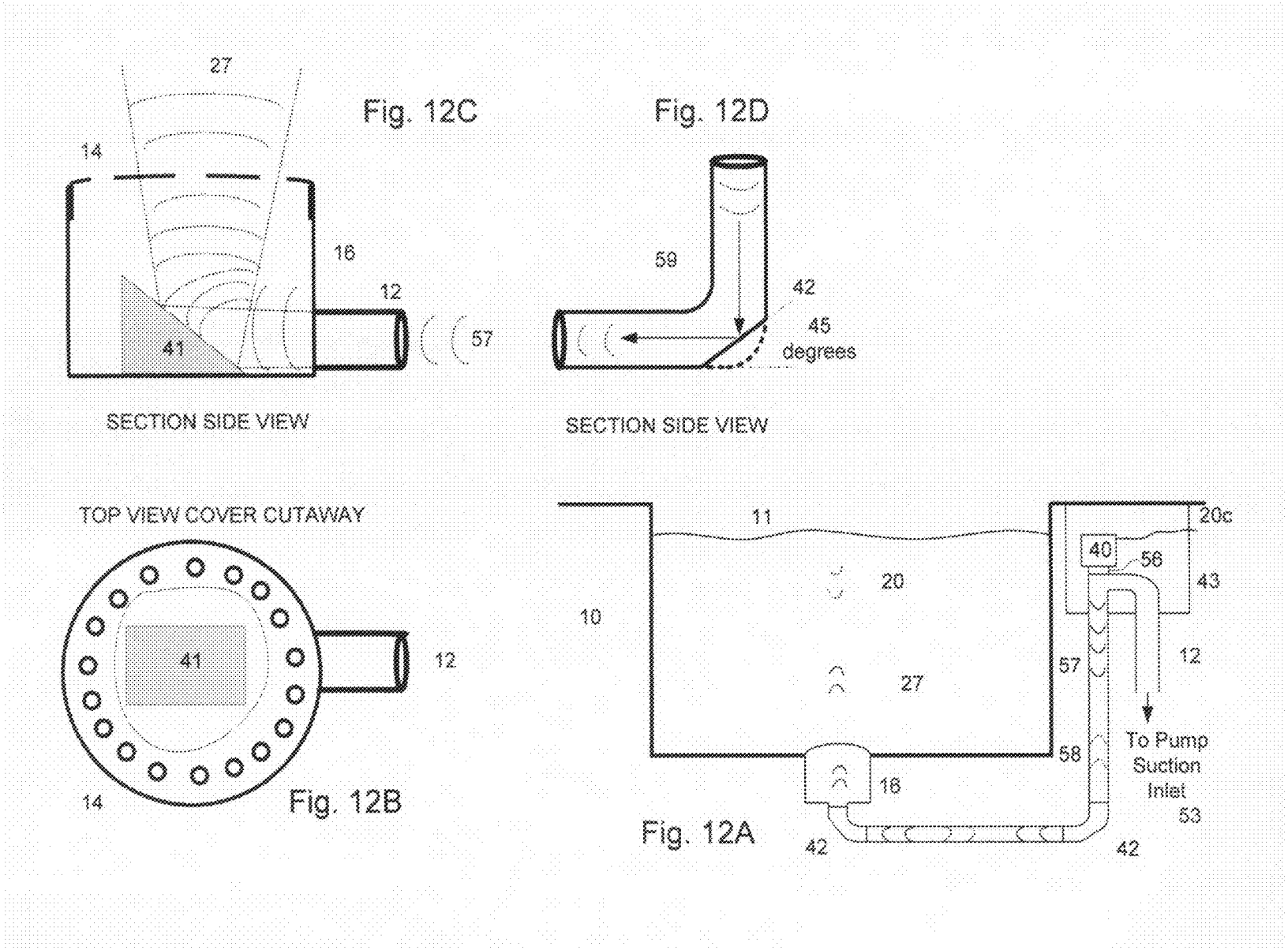

FIG. 12A Transducer deck canister installation of transducer and low loss 90° elbows.

FIG. 12B Top view of 45° ultrasonic reflector in drain.

FIG. 12C Side view section of 45° reflector in drain.

FIG. 12D Side view partial section of standard 90° elbow with modified heel and 45° ultrasonic planar reflector.

Figure 12E:
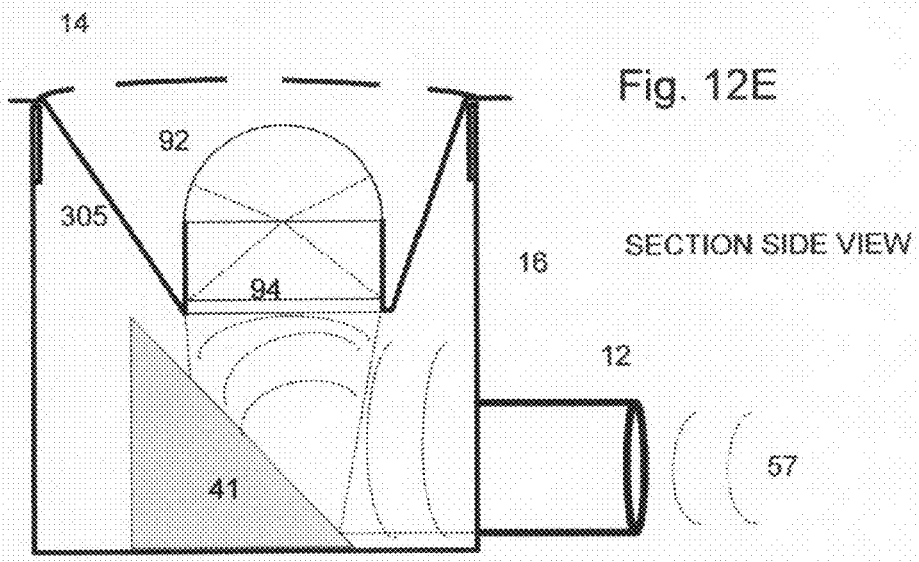

FIG. 12E Hemispherical and Fresnel lenses in drain with 90° reflector feed.

Figure 12F:
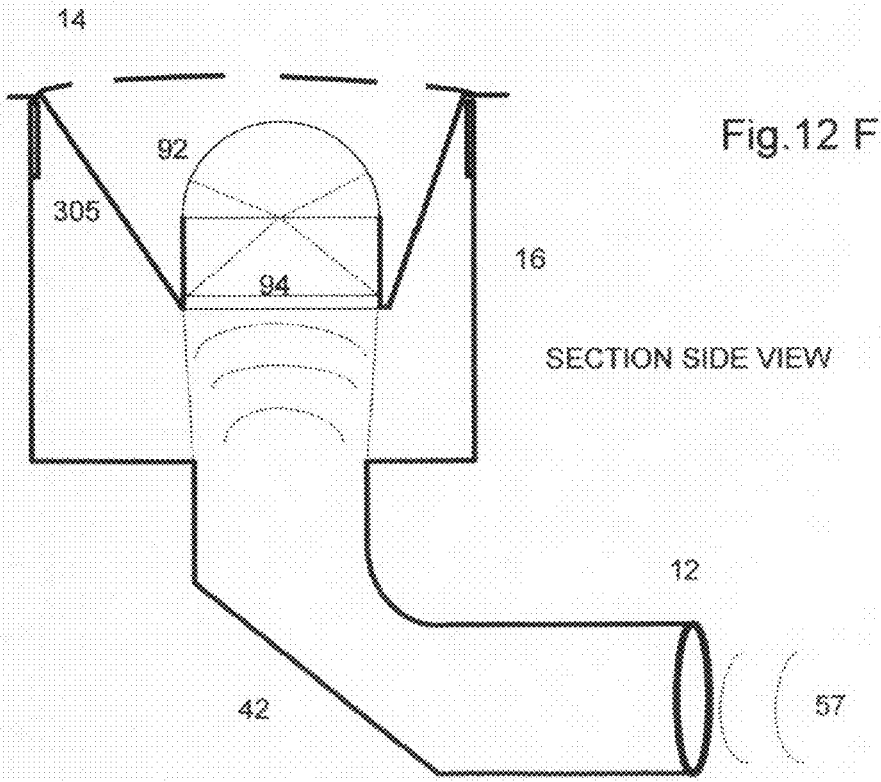

FIG. 12F Hemispherical and Fresnel lenses in drain with modified 90° elbow feed FIG. 13A Separate pool deck canister installations of transducer and skimmer.

FIG. 13B Transducer deck canister combined with skimmer.

FIG. 14A Pool Alarm Surveillance Mode covers full pool volume with hemispherical pattern above drain.

FIG. 14B Pool Alarm has detected a loss of reflections due to an object that has Fallen-In.

FIG. 14C Cause and Effect Algorithm for Table 3 Pool Alarm Mode Decision criteria and logic Table 3 Pool Alarm Model and Algorithm FIG. 15A Pool Alarm Mode: No swimmer in pool, echo reference pattern.

FIG. 15B Pool Alarm Mode: Non-swimmer or object fell-in pool, pattern changed.

FIG. 15C Active sensor pool alarm prior art.

In the drawings closely related figures have the same number but different alphabetic or alphanumeric suffixes.

DETAILED DESCRIPTION

Detailed descriptions of a preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Preferred Embodiment

Description—FIGS. 1A, 1D, 2B, 3A, 3C, 3E, Table 1, 3G, 4A, 5A, 5B, 7A, 7B, 7C, 8A, 8D, 9A, 9B, 9C, 9D, Table 2, FIGS. 10, 10A, 10B, 11, 14A, 14B, 14C, Table 3, 15A, 15B, 15C.

A preferred embodiment of the system and apparatus includes several elements, details of which, are shown in the above group of Figures and Tables. FIG. 1A shows the pool 10 containing water 11 a drain 16 a drain cover 14 and a suction pipe 12 that leads to the pump inlet (not shown here). Also a swimmer 13 encounters the sensor waves 27 emitted through the drain cover 14. Reflection echoes 20 are produced by the swimmer 13 and the water level 11.

FIG. 1D defines several additional range cells or gates, so that logical decisions can be implemented to protect swimmers while minimizing the false alarm rate. FIG. 1D shows the time and distance, or range 69, structure for ultrasonic waves in water. A plurality of Range Cells, or gates, are shown as parts 71 through 79. Also, Receiver Gain 70 is designed to vary from Min. to Max. in a nonlinear, but proportional, manner.

FIG. 2B depicts the ultrasonic transducer 30 location within the drain 16, the drain cover 14, suction piping 12, and a cable pair 32 connecting transducer 30 via connections 31, to the remote transmitter and receiver as shown in FIG. 4A. This configuration is the most available, compared with FIGS. 2A and 2C, and has been pool tested with standard fishfinder transducers for deep pools, and PVDF polymer film nonresonant transducers for shallow pool equivalents. An external conduit (not shown) can also be used to house a cable feed for transducer 30 by means of port 34 or equivalent.

FIG. 3A shows a preferred mounting structure for the ultrasonic Acousto-Optic assembly cylindrical transducer housing 311 comprising 302, 304, 303, 306 and 20C. The top view FIG. 3C, shows the support bracket 305 to have a plurality of spokes attached to an annular flange 305. The bracket flange is sandwiched between the drain rim flange 315, anchored to the pool bottom 320, and the drain cover 14. The cable 20C connects the assembly to the remote transmitter and receiver via suction piping 12. The envelope 310 for the support bracket 305 and the cylindrical transducer housing 311 is shown as a variable size dependent on the selection of Acousto-Optic elements 3D, E, F and Table 1, but is defined to provide clearance for water circulation 309 and the minimum drain depth.

The spacing of the hemispherical lens 302 to the drain cover 14 is dimension 300 that is predetermined and fixed regardless of the total height of the hemispherical lens 302 and the planar transducer and focusing lens assembly 304. Thus, bracket 305 must be designed to provide that clearance dimension 300, when installed, with the drain cover 14 is installed over the transducer assembly 311.

Figure 3E:
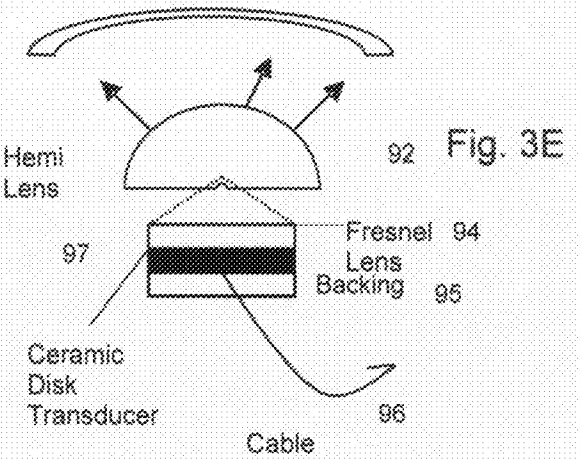

FIG. 3E shows a preferred transducer and acousto-optic structure required to generate the desired, nearly hemispherical, ultrasonic pattern coverage above the drain cover 14. The ceramic disk transducer 97, creates a planar wave, and is connected to the remote transmitter and receiver with cable 96. The transducer 97 is mounted with Fresnel lens 94 and backing 95. The Fresnel lens 94 spherically focuses the transducer plane wave to a small area at the center of the base of hemispherical lens 92. Thus, spherical waves are radiated from the convex surface of hemispherical lens 92; and then must pass through the drain cover 14 without major distortion of the desired hemispherical pattern above the drain. The hemispherical lens 92 and drain cover 14 must be modified as necessary to cooperatively provide the desired hemispherical pattern above the drain cover 14.

Table 1 depicts, summarizes advantages and disadvantages, and the sources of supply for, the Acousto-Optic components in several alternative embodiments. As described above, FIG. 3E is a present preferred embodiment and Table 1 presents the key reasons for this choice. Since a major factor in the choice is determined by expected cost in production, it may be that another configuration will be preferred in the future. FIG. 3G shows the prior art validation of the planar transducer, spherical focus, hemispherical lens configuration 91. The azimuth pattern 89, and the elevation pattern 90 test were taken at a useful frequency, and with similar dimensions to the requirements of the present invention. Further details are referenced in Table 1.

FIG. 4A is a block diagram for the use of a remote transducer with a cable feed. The transducer 17T is connected via cable 20C to the T/R unit 22 which is then connected to the Logic and Control (L/C) unit 35. In normal operation, the L/C 35 sends an OK signal to the Alarms and Indicator 39 and a Green light will be displayed for the system status. When a Pump Shutdown is deemed necessary the L/C unit 35 interrupts the Pump Control Signal 37, disconnecting the Pump from Power Source 38. Then the L/C unit 35 sends a No-Go signal to the Alarms and Indicator (A/I) unit 39, the status light changes from green to red, and various alarms are sounded both locally and, if desired, remotely.

FIG. 5A shows the physical arrangement of a typical pump and inlet side piping 53 and elbow fitting 59 leading to the underground pool drain, before modification. Also shown are the ground level 52, water pump 50, pump motor 51 and pump control 37.

In FIG. 5B the main modification is seen to involve removing the 90 degree elbow 59 and reconnecting the piping 53 with a standard T fitting that will both restore the water path and enable the long, variable length cable 20C to connect with the transducer in the drain 16 (not shown). The housing 55 serves to insert and seal the cable 20C, in this preferred embodiment, rather than a transducer as used in an alternative embodiment, to be described under Alternative Embodiments.

FIG. 7A shows echo data at 3 frequencies for a Drain Cover echo 200, 201, 202 which is typical of both new construction and retrofit situations.

FIG. 7B shows echo data at 1 mHz for a drain cover echo 203 and a hand 204 and 205 nearby the drain cover.

FIG. 7C shows the use of range gates 206, 207, 208 to sort the hazard level based on distance from a drain cover echo 209.

FIG. 8A shows in more detail echo data for the Drain Cover 209 and a Hand echo 210 and a No-Go gate 211. We also can see in the lower panel of FIG. 8A the real time FFT display 212 for the hand echo 210.

FIG. 8D is a simplified propagation model to show the general trends that relate frequency with relative attenuation and relative small target detectability. FIG. 8D shows qualitative tradeoffs between small target detectability 223 and relative ultrasonic attenuation 224 as functions of frequency 225

FIGS. 9A,B, C show the type and sequence of echoes, drain cover 81, water level 82, standard target echo 83, and a hand echo 85, that is received under typical close range, wading pool conditions. Also shown are comparator gate outputs 84 triggered by the standard target 83 in FIG. 9B, and the hand echo 85 in FIG. 9C. FIG. 9D is a Cause and Effect Diagram that is another way of understanding the general algorithm that governs the automated system operation.

Table 2 describes the criteria for each of the predefined cases that will use the critical type of echo data to allow the pool circulation as normal, or shutdown immediately when decision criteria have been met. Table 2 is a specific algorithm for the process of using the ultrasonic echoes data to arrive at, and implement, logic decisions concerned with pool flow control for swimmer safety.

FIG. 10 shows the decision logic implementation as a decision tree for each of the five predefined cases that require flow control decisions. Earlier, there was a Case 3 also considered but it was deemed to be redundant and removed when certain simplifications in the logic were made. The case numbering was not adjusted and so the data is correct but the five surviving cases are, arbitrarily, 1, 2, 4, 5, and 6. A much simpler decision logic, and its hardware implementation, has resulted as shown in FIGS. 10, 10A and 10B. FIG. 10 shows the method and decision tree logic. FIG. 10A shows the logic circuit schematic, which has been validated with a logic circuit simulator. FIG. 10B shows, on a time scale for a single scan:

echoes in each range gate under normal operating conditions all relevant range gates the master range gate 101

Drain Cover decision pulse 130 and digital storage latch 135

NO-GO decision pulse 150 and digital storage latch 152

Ok decision pulse 160 and digital storage latch 163

Water Level decision pulse 140

FIG. 11 shows the schematic for assuring that fail-safe priority in the decision logic is established. Truth table 176 is the algorithm for the process of pool flow control to provide that priority. The Flow Control OFF latch is 179; which also controls the alarms 39.

FIGS. 14A, B illustrate the geometry of a pool alarm mode to detect an object or person 13 that has fallen into the pool.

The bottom drain 16 location is unique and a useful position from which to create the ultrasonic fields and waves that establish a normal reflection pulse sequence timing.

FIG. 14C is a cause and effect algorithm for the pool alarm mode. Starting with the pool containing only water 1, the long range echoes due to multiple bounce reflections from the water surface, walls and floor 2 and 3 create a reference time index of pulses for each scan. Successive scans are compared in a difference detection, then A to D converted for storage 7. A Compare gate 8 is used to determine if the difference is indicative of the same water paths of FIG. 14A, and, if so, comparisons continue 9.

If a significant change is detected, e.g. pulses 4 and 5 replacing 2 and 3, indicates that a reflective and absorptive object has appeared in the water as in FIG. 14B, panic alarms 39 are activated to summon immediate help.

FIGS. 14A and B form a simple model that we can use for measuring ray path segments and converting to total distance and time to observe a more quantitative object detection process. Table 3 shows the scaling applied to FIGS. 14A and B, and calculates total ray travel distances and times. The timing of these direct echoes and multiple bounce reflections are plotted in FIG. 15A for the water only reference case of FIG. 14A; and FIG. 15B does the same for the object in the water case of FIG. 14B.

FIG. 15C shows prior art for an active ultrasonic sensor that uses a horizontal detection plane, and senses only path redirection, but not direct object echoes. The present invention senses both types of changes to the reference pattern of reflections; and does so throughout the water volume rather than only in a limited horizontal water plane.

Preferred Embodiment Operation

FIGS. 1A,D, 2B, 3A,C,E, Table 1, 3G,4A,5A,B, 7A,B,C, 8A,D,9A,B,C, Table 2, FIGS. 10,10A,B,11, 14A,B,C Table 3, 15A,B,C.

A preferred embodiment in FIG. 1A embodies one of the most important operational aspects of this invention. Radiating ultrasonic sensor waves 27 from within the drain 16, via the drain cover 14, insures that the closest swimmer 13 reflection echo will be detected first; and cannot be blocked by the presence of a plurality of other swimmers, as could be the case for any other sensor wave 27 direction of arrival. Also, reflection echoes 20 are received from the drain cover 14, preceding all other echoes; and of final interest, a water level echo 11. The drain cover 14 echo is used to both assure that the drain cover 14 is in place, and as a system self-calibration reference as to the distance of any object from the drain 16. The water level echo 11 is used both as a system self-test reference, and as an indication of water level 11 being too low or too high, and can issue warnings or alarms when close to extreme levels.

FIG. 1A shows three sources of reflection echoes 20 that are monitored continually:

drain cover 14 swimmer 13

Water level 11

FIG. 1D shows how this monitoring is done at a system level; the method described is well known in radar and sonar prior art. Range cells 71-79 are defined by time intervals measured from the transmitted pulse (main bang) 71 as shown on the time and range scale 69. The drain cover echo 73 is expected to be fixed in time, and therefore in range, related by the velocity of sound in water. A range gate is thereby provided that occupies the same time slot 73 and both signals are input to an AND gate and logic inverter gate. Thus, a missing drain cover echo 73 would trigger the STOP command of Case 4 and this fact is used in the decision logic algorithm further described in Table 2 and FIGS. 10, 10A and 10B The same is done for the water level echo in time slots 77-79, but since that echo time slot is expected to vary by a few inches, say plus or minus three from normal 78 we provide three range gates to know when a water level alert is required, using AND gate logic.

The swimmer echo 13 is expected to occur over a relatively wide range of distance when first detected, so we provide a swimmer OK range gate 76, and a swimmer No-Go range gate 74. Again, the logic algorithm is found in Table 2 and FIGS. 10, 10A, and 10B.

Obviously, an echo 20 in the swimmer No-Go range gate 74 would call for a flow control shutdown. Examples of actual test data for a shallow pool, e.g. wading pool, are shown in FIGS. 9A,B,C that also show a standard comparator gate 84 triggered by a hand echo 85 at a distance of 7 inches. The comparator gate 84 is typically a 5 volt logic pulse that is used to trigger and latch a flow control shutdown as shown in FIG. 11.

FIG. 1D also indicates that receiver gain 70 control will be used to normalize echo amplitudes for a wide range of input signal levels. This can be done is several ways, but a preferred method is to use a log amplifier IC such as the Analog Devices AD8307 or AD606. The test data of FIG. 9 used the AD8307.

FIG. 2B is part of the preferred embodiment. The transducer 30 shown is generic only and is much further described in FIGS. 3A, C, E, and Table 1. The suction piping 12 is also used as a conduit for a thin coaxial or balanced cable and connects, as shown in FIG. 4A with the transmitter and receiver 22 via a cable 20*c* (identified as 32 in FIG. 2B). Due to ultrasonic reciprocity, the echoes 20 in FIG. 1A retrace the geometry of the sensor waves 27 and return to the drain 16 via the drain cover 14 and continue until they are absorbed by the same transducer, for example in FIG. 2B 30, that produced the sensor wave 27 pulse. Thus, the transducer acousto-optic assembly 311 in FIG. 3A will convert the ultrasonic echo pulses to electrical analogs and via cable 20C connect to the transmitter and receiver 22 of FIG. 4A.

FIG. 3A is a preferred embodiment because it provides in a simple cylindrical housing 311 a well controlled nearly hemispherical beam above the drain cover 14, a predetermined spacing 300 to the drain cover 14, and is fastened securely to the drain rim flange in a predetermined geometry 305 such that the drain cover 14 can be removed or replaced without disturbing the transducer assembly bracket 305. This fastening arrangement is shown also in FIG. 3C. Three screw fasteners secure the transducer assembly bracket 305 to the drain rim flange 315 as shown in FIG. 3C; and two additional screw fasteners attach the drain cover 14 to the drain rim flange 301 (a standard pool industry design) using clearance through holes 308 in the transducer assembly bracket 305 to complete the sandwich.

The point of this assembly design is that a missing drain cover is instantly detected by the range gate AND circuit previously described with FIG. 1D. The cable connecting the transducer and acousto-optic elements assembly 311 to the transmitter and receiver 22 in FIG. 4A is 20C as in FIGS. 2B and 4A In operation there is ample space for water passage around the 311 assembly as shown in FIG. 3C top view as the suction piping is typically 2 inch or less in diameter. A good design reference as to dimensions for this transducer application is an active element array diameter in the range of 2.5 cm. to 5 cm and 1 to 3 cm. high. The typical drain 16 diameter is approximately 20 cm. by 15 cm. depth so there is adequate space available within the drain 16 to install the transducer array assembly 311, as shown in FIG. 3A, envelope 310.

FIGS. 3D, E, and F show the structural configurations for the ultrasonic transducer and acousto-optic elements. These are embodiment options for the overall system or apparatus, but all three are feasible based on prior art and can be considered. A preferred embodiment is represented in FIG. 3E in terms of ultimate cost, size, and product design flexibility. The required beam shape for full azimuth coverage around the drain and maximum hemispherical coverage in elevation drives the design, and is the reason for the complex assembly required. Note that in each case the common element that contributes to the beam shaping is the drain cover 14. The drain cover 14 design requirements at present are controlled by ANSI/ASME and APSP Standards in terms of structural strength, domed shape, and water flow rates but do not yet consider the ultrasonic characteristics. It is incumbent on the maker of this invention to work closely with the major manufacturers of drain covers, and the APSP Standards Writing Committees to assure that the relatively new ultrasonic requirements are considered in future Standards revisions. A significant reason to prefer the design in FIG. 3E is that the hemispherical lens 92 and the Fresnel type lens 94 in combination offer simpler, and less expensive means to correct for the effects of the drain cover 14. Development testing has shown that the orientation and spacing of the drain cover 14, and operating frequency all affect the final pattern 307 above the drain cover 14, in elevation. The full coverage in azimuth is largely a function of axisymmetry and since all elements have rotational symmetry, aligning the axes of all elements is required.

The acousto-optical elements can be trimmed to optimize the pattern 307. Normalizing the amplitude response as described in FIG. 1D helps considerably to assure detectability at all azimuths, and all essential elevation angles.

The hemispherical lens 92 appears in FIG. 3E. Prior Art is disclosed in FIG. 3G 91 and it can be seen to cover a part of the FIG. 3D structure. The purpose of this prior art was as a materials test fixture but the operating frequency, 1 MHz, and dimensions of a 50 mm hemisphere diameter 89 and 90 both relate closely to those requirements of this invention. Table 1 is a summary of the three types of acousto-optic configurations described in FIGS. 3D, E, F with further information on "sources of components and how to make"; descriptions; and advantages and disadvantages of each option. The preferred approach may require a custom design for a Fresnel type lens 94, but the technology is well established as shown in Table 1. An exact "off the shelf" product with the required focus, frequency and dimensions may require custom design and fabrication, but is clearly available to one skilled in the art.

FIG. 4A is a block diagram of a complete system with a remote transducer 17T and long cable 20C connection to the transmitter and receiver 22. The transmitter generates the tone burst pulses that energize the transducer 17T which converts the electrical pulses to analogous ultrasonic pulses, that are then radiated from within the drain 16 as previously described. The receiver amplifies, normalizes, filters and thresholds the reflected echoes and converts the analog signal pulses to one bit digital logic pulses, for example see FIG. 9B 84, using standard radar or sonar techniques. These logic pulses retain the original timing and sequence of received echoes and pass them to the Logic and Control unit 35 in FIG. 4A wherein predetermined Decision Criteria per Table 2 are applied to determine if action to turn off the flow controller is required by the data received. The details of this Logic and Control are discussed under FIGS. 9, 10, and 11 with the algorithms shown in Table 2. If flow control is required the pump shutdown switch 36 FIG. 4A is activated, as well as alarms and indicators 39. The pump control signal 37 operates the pump power relay as required by the algorithms of Table 2.

The preferred embodiment at the present time is that shown in FIG. 4A, since all elements are well understood, and available as a standard or custom design.

Transmitter Details

The transmitter architecture for this active ultrasonic sensor is prior art technology. It consists of a radio frequency pulse generator at a frequency in the range 600 kHz to 1200 kHz; and a suitable amplifier to drive the transducer array at a level of at least 200 volts peak to peak. The load impedance of the array will generally be highly capacitive, perhaps several nanofarads, so matching should be provided according to well known techniques such as series or parallel inductors. The pulse width should be in the range of 30 to 50 microseconds. The frequency range is in the familiar AM radio band so that components are readily available.

Receiver Details:

The receiver is also simplified in the sense that it must operate in the same band and at the same frequency as the transmitter. This technology is also from prior art. However, since the range of echo amplitudes is on the order of 80 decibels (db) a very fast automatic gain control (IAGC or log amp) architecture is mandatory. Many radar texts cover the design of such systems. It has proven useful in the development and test of this sensor system to make use of a linear preamp with a gain of 20 db., followed by a logarithmic amplifier with a dynamic range of 60 db. Examples of available components that are useful for this receiver are supplied by Analog Devices Incorporated, of Waltham, Mass.

AD606 80 db. demodulating Log Amplifier
AD8307 92 db demodulating Log Amplifier
AD604 40 db Variable Gain Amplifier The Test data shown in FIG. 9 was obtained with a receiver using an AD8307 Log Amplifier. The frequency was 1070 kHz and the pulse width 25 microseconds.

Filters and Other Signal to Noise Improvement Techniques:

The amplifier integrated circuits listed above are very wideband and significant filtering is needed to provide the high signal to noise ratio, at least 20 db at threshold, required by an automatic sensor. Otherwise the false alarm rate would become a nuisance. Therefore the data in FIG. 9 show the benefit of a four section, maximally flat, bandpass filter tuned to the center frequency of operation, 1070 kHz. Further, the use of a coincidence detector is a valuable tool to control the false alarm rate. Both the filtering and other items discussed are all in the prior art and covered by many text books and so familiar to one of ordinary skill in the art.

Transducer Interface:

An additional consideration for the receiver is providing the equivalent of a Transmit and Receive Switch. This is well known in the prior art in radar texts and is required to avoid overloading the receiver with leakage from the transmitted pulses. The issue here results from the need to see the drain cover echo that occurs only a short time after the transmitted pulse. FIG. 9 clearly shows the situation, and the fact that the transducer used was a broadband, low Q, non-resonant polymer film type it is relatively simple to maintain high range resolution at very close range. In the case of a ceramic transducer operating at resonance special damping circuits would be required at such a close range. These circuits are also well known in the prior art.

Packaging:

It should be apparent that there is nothing unusual about the circuits and packaging of the electronics shown and described in FIG. 4A, because the technology of the transmitter and receiver 22 is similar to currently marketed fishfinders such as made by Humminbird®, Furuno®, and Techsonic Industries®. Other familiar products that utilize the same range of frequencies include AM transistor radios; while alarms and indicators are commonplace in home security systems.

The parts of this invention that are unique or unfamiliar such as ultrasonic pulses radiating from drains, transducers and acousto-optic lens elements, receiver log amplifiers, logic and control algorithms, and falling-in pool detection are described in full detail so that one skilled in the art may make and use the invention without extensive experimentation.

FIG. 5A shows the physical arrangement of a typical pump and inlet side piping 53 and elbow fitting 59 leading to the underground pool drain, before modification. This arrangement is typical of many existing installations that would be candidates for a retrofit with a preferred embodiment of this invention.

FIG. 5B shows the preferred modification for retrofit applications wherein the suction side piping 53 is also used as a conduit for the long cable 20C connecting the transmitter and receiver 22 to the remote transducer 17T in the pool drain 16; as was shown in FIG. 4A. The main modification is seen to involve removing the 90 degree elbow 59 and reconnecting the piping 53 with a standard T fitting 56 that will both restore the water path and enable the cable 20C access. The added Tee fitting 56 allows the cable 20C installation, and provides for an air and water tight cable seal and end cap pipe closure. The seal and pipe closure is removeable so that a transducer replacement is straightforward. The use of a standard PVC schedule 40 threaded adapter and pipe cap parts simplifies the installation, and removal if necessary.

FIG. 7A shows echo data at 3 frequencies for a drain cover 14 which is typical of both new construction and retrofit situations such as described in FIG. 5B above. A larger and more defined echo was obtained at 660 kHz FIG. 7A-2 201 compared with 1 mHz FIG. 7A-1 200, but both are quite acceptable. FIG. 7A-3 shows another drain cover 14 echo 202 at 600 kHz; with a 10× magnified time scale. This clearly shows excellent pulse resolution and high signal to noise ratio at close range.

FIG. 7B shows echo data at 1 mHz. In FIG. 7B-1 there is only a drain cover 14 present. The echo is 203. FIG. 7B-2, contains the echo of a person's hand 204 as well as the drain cover echo 203. FIG. 7B-3 shows a 10× magnification of the horizontal time scale at the hand echo 205 and we can see distinct groups of echo pulses. This may be due to more than one finger reflection or the hand orientation but it provides a characteristic "signature" which is useful for object classification purposes.

FIG. 7C shows the use of range gates to sort the hazard level based on distance from a drain. FIG. 7C-1 shows the drain cover echo 209 within a range cell gate 206 that would be the normal, safe, condition. FIG. 7C-2 again shows the drain cover echo 209; and the Close Swimmer Range Cell gate 207, which is equivalent to Range Gate 74 or 75 in FIG. 1D. An echo in this cell (above threshold) would call for an immediate pump shutdown. This gate, 207 as shown, has an extent in range of about 38 cm. (15 inches) beginning at the end of the drain cover range gate 206.

FIG. 7C-3 shows a drain cover echo 209 and a Far Swimmer Range Cell gate 208 that begins at the end of the Close Swimmer Range Cell gate 207 and extends for several feet; equivalent to the swimmer OK range gate 76 in FIG. 1D. It is also equivalent to the OK Gate referred to in FIG. 9D and table 2. This cell is for monitoring swimmer activity and would not call for an immediate pump shutdown, but could be used to generate a warning/alarm signal when this cell is occupied. As described further under FIG. 9, the use of this data provides a means of self-test when the water level 11 echo is partially or completely blocked (example shown in FIGS. 9B and C 82); and forms an integral part of the decision criteria shown in Table 2 for Cases 5 and 6.

FIG. 8A shows in more detail echo data for the Drain Cover echo 209 and a Hand echo 210 about 5 inches from the drain cover 14 and in a No-Go gate 211. We also can see in the lower panel of FIG. 8A the real time FFT display 212 for the hand echo 210. This illustrates the signal to noise improvement that can be realized with the equivalent of a matched filter or correlation signal processing.

FIG. 8D is a simplified propagation model to show the general trends that relate frequency with relative attenuation and relative small target detectability In general the higher the frequency the greater the attenuation, and the better the detectability providing that an adequate S/N ratio can be maintained. Likewise, lower frequencies suffer less attenuation but also do not detect small targets very well It should be understood that more than one transducer or frequency mode can be employed in an installation and particularly for new construction can offer the best of both options with high resolution up close using high frequencies and longer range for distance coverage at low frequencies. This may be characterised as a dual mode configuration.

Range Resolution Allows All Essential Echoes to be Sensed and Processed in Combination:

FIG. 9A, B, C is most useful for understanding, making and using the invention because it is test data and combines the detected echo signals of interest and shows how a comparator circuit, operating within the defined close swimmer range gate, is used to convert from analog 83 to digital format 84 for use in the logic and control decisions.of FIG. 9D and Table 2.

FIG. 10 102 is a summary graph of all echoes of interest and swimmer NO-GO and OK range gates that help in the interpretation of FIG. 9A, B, C descriptions below:

The range scale is shown, and is the same for each of the three panels FIGS. 9A, B and C. FIG. 9A, B, C data is typical of a shallow wading pool where the water level echo 82 was only about 25 cm. (10 inches) above the drain cover echo 81. Deep water pools obviously require some scaling of parameters to achieve the water level echo 82 range that is also important to the decisions in two of the cases shown in Table 2.

In FIG. 9A a transmitter pulse sample 80 is the time zero reference, and the drain cover echo 81 separation is approximately 6 cm. That dimension for each pool will of course be known and remains fixed as a matter of construction. The water level echo 82 is much stronger than any other echo understanding that these waveforms are on a logarithmic amplitude (vertical) scale and thus greatly compressed which is helpful for thresholding in an automatic surveillance system.

FIG. 9B shows the effect of adding a standard target (a ping pong ball) 83 between the drain cover echo 81 and the water level echo 82. Clearly the water level echo 82 is greatly reduced because this beam is narrow and the target 83 effectively blocks most of the energy. Note that a comparator gate is now generated by the target 83 amplitude exceeding a predetermined threshold. The comparator gate 84 is used to make the circulation shutdown decision when a target enters the swimmer NO-GO range gate 74 or close range gate 75, as shown in FIG. 1D.

FIG. 9C shows a similar situation but with an actual hand echo 85 as the target. Notice that the water level echo 82 is reduced even further because the hand is so much larger in dimension, and also more absorptive, than the standard target 83. While geometrically larger, the hand is not as good a reflector as the standard target and this is evident in the data. Despite the smaller amplitude, (above threshold) a comparator gate 84 is generated and would thereby lead to a shutdown decision by the predetermined logic. A detailed description of the logic embodiment is covered in the algorithm depicted in FIG. 9D and the predefined cases identified in Table 2.

FIG. 10 is a decision tree representation of the logic algorithm for each of the cases of Table 2. FIG. 10A is a detailed logic schematic of a preferred embodiment of the solutions for each of the predefined cases required in Table 2. Also, both of the logic schematic level circuits shown in FIGS. 10A and 11 have been evaluated with a Logic Simulator program and are seen to be functionally proper for this application and system.

Decision Criteria and Logic

FIGS. 10, 10A, 10B and 11 shows a preferred embodiment of the Decision Criteria and Logic employed in this system to safely control the water circulation that otherwise creates a suction entrapment hazard for swimmers near drains. A simplified version of the echo data detailed in FIG. 9A, B, C is also shown in FIG. 10 102. We start with the Active Ultrasonic Sensor System 100, Signal Processing means 110 (that include three data latches to overlap the comparator logic pulses in time on each scan, for the four types of echoes (drain cover 81, No-Go 84, OK gate 76, and water level 82) that obviously occur in a time sequence based on range from the drain cover 14 as shown in FIG. 10 and Table 2.

This must be done because the water level echo 82 is considerably delayed in a 6 foot deep pool and the No-Go echo may extend up to 18 inches from the drain cover Echo 81. The Ok gate 76 echo is still further separated in time. For the AND gate logic shown in FIG. 10A, it is imperative that each AND gate input is present simultaneously to effect the required automatic flow control decisions. FIG. 10A shows that three of the AND gates use two processed echo inputs, and one uses three processed echo inputs, while in Case 4 (missing drain cover 14) there is no AND gate because this is the earliest data pulse and the absence of the drain cover requires an immediate shutdown of the pool.

This kind of priority planning results in fewer components, connections, and complexity and is responsible for the "Don't care" entries in Table 2. That usage does not mean that the data is unimportant, and is quite standard in logic design. It simply means that "don't care" says that, for a particular case, that category of data need not be involved in the decision logic. For example, It turns out that the OK Gate echo data 98 is used in two of the five cases as shown in Table 2 and FIG. 10A. Case 5 is for the "object on the drain cover 14" and requires a Stop Flow and Alarm; the other is Case 6 and is a Normal operating condition.

The logic for all five cases is shown in FIGS. 10 and 10A and Table 2. The echo sequence, 102 leads to many possible logic combinations, but only a few require decision criteria status. Table 2 defines five predetermined logic cases that include all of the relevant echoes and their locations relative to distance from the drain cover. Thus, all situations that require Flow Control action are preconsidered and therefore the decision criteria can be logically applied for automatic intervention in three of the five cases as shown in FIG. 10A. There are two cases 1 and 6 that are considered to be normal operation requiring no intervention, but they are involved in any restarts after a STOP FLOW as in case 2; and in helping to avoid false alarms in case 6 when a swimmer is detected in the OK gate 76 thus providing assurance that the sensor 100 is functioning normally despite the temporary blocking of a water level echo 82, in the water level gates 77-79.

This use of the swimmer OK gate 76 and echo is very important to assure that the sensor is operating properly because if there is no water level echo, as described in Table 2 Case 5, there could be an object covering the drain cover 14 (e.g. a towel), a sensor problem, or water level extremes. Any of these events requires immediate attention to assure that swimmer safety, and safe pool operation, is being maintained.

Decision Cases:

The logic for the decisions in all five cases is tabulated and described completely in Table 2. An embodiment using AND gate and inverter logic is shown schematically in FIG. 10A for each Case. A brief discussion of the key issues for each case follows:

Case 1: As shown we have the drain cover echo, and water level or wall echo, and no swimmer echo of interest, so this is the normal operating condition and no intervention is required.

Case 2: We have the Drain cover echo, the water level or wall echo, and a swimmer in the NO-GO Range gate. This is a hazard and calls for an intervention. The system will STOP FLOW for several seconds, then monitor for the absence of a close swimmer echo and restart Flow when clear. If no restart is allowed the ALARMS will start because some condition requires attention.

Case 4: This case shows the extreme danger condition where there is no Drain Cover echo and it calls for an immediate STOP FLOW and START ALARMS. No restart is allowed.

Case 5: The actions in this case will be the same as Case 4, but for very different reasons. As shown in Table 2 the Drain Cover 14 echo is present but no other echoes are sensed. Following the listing in Table 2 the decision is a hazard exists because, in effect we have a system failure and the fail-safe design requires that STOP FLOW and START ALARMS occurs with no restart allowed. Referring to Table 2 we see that the system failure could mean that only an object like a towel or leaves is blocking the drain cover; or an equipment problem; or very low water level is the cause. This is a good demonstration and test mode.

Case 6: The drain cover echo is detected but the water level echo is effectively missing. But since there is a swimmer echo at a safe distance from the drain, in the OK range gate, merely blocking the water level echo, we know that the system is operating properly. This is the other Normal mode Case and shows why we need to see a swimmer echo in the OK range gate for this case.

Method and Decision Tree Logic:

FIGS. 10 and 10A shows a preferred form of logic to interface the processed echoes 110 into Flow Control decisions 170 based on predetermined criteria. An automatic sensor system must measure or detect the discriminants (the echoes and range gates 102) and apply the hardwired logic 131, 140,150 and 160 in each of the important cases of interest and one simple way is the use of AND gates 134,136, 154 and 162. There are also several inverters that either augment an AND gate, or as in Case 4 directly control the STOP FLOW 170 because the drain cover 14 echo was not present. This type of combinational logic is well known in the prior art and the schematics are self explanatory, for one skilled in the art, because the logic process is completely disclosed and presented in detail in Table 2 and FIGS. 9D, 10, 10A, 10B and 11.

FIG. 10B relates the echo scan results for each transmitted pulse with the necessity for combining time separated echoes in a logical combination to decide what flow control actions are required to maintain safe conditions for swimmers in a deep pool. The echoes and range gates are shown in the actual sequence along with the digital logic pulses produced from the analog echoes. The subsequent need to provide temporary storage for the digital logic pulses so that all echo channels will have available the proper value of each during the scan for the necessary AND gate functions as shown in FIG. 10A. Such storage latches are well known in the prior art.

FIG. 10B shows the real time relationships for a single echo scan. There is one scan per transmitter pulse. The transmitter trigger pulse (the pulse repetition frequency, prf trigger) causes a reset of all latches at the beginning of each echo scan.

A Master Range Gate 101 is used to exclude transmitter leakage pulses, echoes and noise pulses beyond the limits of the defined echoes of Table 2, by means of an AND gate using the individual Echo Range Gates 72-79 and the MRG 101.

Since the echo pulses do not arrive at the same time it is necessary to store digital versions at least until the water level range gate 77-79 completes the scan. These Decision Pulses and Digital Storage Latches are shown in FIG. 10B for each of the decision echoes:

Drain Cover 81, 130, 135

Swimmer NO-GO 85, 150, 152

Swimmer OK 98, 160, 163

Water Level 82, 140

No storage latch is needed for the Water Level Decision Pulse 140 because it is the last Decision Element in a scan and interacts directly, as in FIG. 10A, with the stored Decision Elements listed above.

Several other forms of digital logic circuits and computer systems are also well known in the prior art. The sensor system described herein does not require a computer but it can be implemented with a computer if there are reasons to do so. One area of advantage to incorporating computer resources would be in the use of Digital Signal Processing (DSP) because of the need to maintain high signal to noise ratios to avoid false alarms. A DSP can in many cases implement very complex filters better and less expensively than conventional analog filters. These techniques are well known also, in the prior art.

FIG. 11 completes the system operation description including the FLOW CONTROLLER 170 schematic. The two AND gates 134, 136 and the inverter 131 that all control a STOP FLOW command are combined in an OR logic function. Likewise, AND gates 154 and 162 are both in command of a restart, or ON, FLOW CONTROL action and are combined in an OR logic circuit. The final logic element 174 A and Not B gate deals with the priority afforded to each of the two basic decisions, ON or OFF. Obviously for a fail-safe system the STOP FLOW must take priority in all cases, whether a swimmer location, system problem, or external factor is involved. The truth table 176 in FIG. 11 represents the algorithm for this method. Case 2 (refer to Table 1) requires an OFF latch 179 if and when no restart is allowed, and alarms 39 are started. Cases 4 and 5 (refer to Table 1) always require an OFF latch 179 when they occur, because auto restart is not allowed, and alarms 39 are started immediately. A manual restart is allowed, in all cases, after corrective action has been taken.

The specific interface design will depend on the existing flow control means for retrofit purposes, while new construction offers other well known relay applications. The pool circulation control system includes a pump, or valves in a gravity flow system 180. These issues are routine, depend on a specific pool system, and are well understood in the prior art.

Method or Process Description

In accordance with a preferred embodiment of the invention, there is disclosed a process for anticipatory sensing and intervention to avoid swimmer entrapment, comprising the steps of:

- Assessing the relative hazard, based on swimmer 13 proximity to the drain cover 14, with an active suction entrapment sensor (e.g. ultrasonic).
- Launching ultrasonic waves 27 into the pool from within the drain 16, and receiving echoes from the drain cover 14, swimmer limbs, hair or body 20, and the water surface 11, or wall opposite the drain, using one or more ultrasonic transducers 30.
- Energizing electrically the ultrasonic transducer 17T, with a transmitter/pulser 22 to launch ultrasonic waves 27 into the pool 10 from within the drain 16. The transducer 17T is connected to the transmitter and receiver 22 by a cable 20C led through the suction piping 12 from the drain 16 to the ground level 52 at the input to the pump 53; then separated from the piping 55 for the transmitter and receiver 22 connection.
- Providing a conventional housing for the Transmitter and Receiver 22, and Logic and Control 35 that is located in the pool equipment area, near the pump inlet piping 53.
- Detecting the echoes 20 produced by electrical signals from the ultrasonic transducer. and receiving echoes 20 from objects of interest beyond the pool drain 16, including but not limited to, the drain cover 14, a swimmer's 13 body, hair or limb in close proximity to the drain cover 14, and the pool water surface 11, or wall opposite the drain, with a receiver/processor 22.
- Converting the detected signals 200 and 210 into reliable information regarding a swimmer safety/hazard status using a logic and control element 35. If a drain cover 14 echo is ever missing from its predetermined position 73, an immediate, latched, stop flow action 36 and alarm 39 will occur.
- Generating a pump shutdown command 37 from a flow controller output 36 if a close approach by a swimmer 13 near a drain 16 is measured.
- All useful combinations of the echoes received 81, 82, 83, 85 are logically combined into predetermined action, based on a logical algorithm FIG. 8D and Table 2, to be automatically activated precluding swimmer 13 entrapment in any form. Alarms 39 will be used, in addition to flow control actions 36, based on a predetermined logical algorithm as in FIGS. 9D, 10, 10A, 10B, 11 and Table 2.

Pool Alarm Mode (FIGS. 14A, B; C; Table 3; 15A, B, C)

The same sensor apparatus is used for the pool alarm mode; the only change in operation is the use of different logic, timing, pulse power level, and alarms as described herein.

The drain 16 at the bottom of a pool allows a unique perspective for sensing an object falling in. Unfortunately the object is usually a very young child, and it happens at a time when no one is using the pool or supervising the pool area. The Consumer Product Safety Commission (CPSC) has stated that in most such cases this situation becomes lethal very quickly. There are several alarm devices and systems that are marketed currently but the most effective, from a structural view, are active and extremely expensive, partly due to complex installations, and therefore not very widely used. The simple passive types are portable but not as effective.

A broad beamwidth, active pulsed ultrasonic sensor installed in a bottom drain 16, as described previously in this specification, can also provide complete coverage of the water volume by taking advantage of the reflecting properties of the water to air interface at water level and the pool side walls and bottom. This rebounding effect is illustrated in FIG. 14A for only three discrete rays 1, 2, and 3, because the volume gets covered primarily with rays that propagate with bounces over a narrow range of angles of incidence. FIG. 14A depicts a reflection pattern due to only two discrete rays 2, and 3. Because the third ray depicted, the water level echo 1, is very close to vertical it, therefore, will return to the drain cover 14, where it may also generate multiple time around echoes, but no wall bounces. Such multiple time around echoes have very specific timing and amplitude decay characteristics that can be used to discriminate them, as necessary. FIGS. 14A and B have been used as scale models to illustrate how this same embodiment can serve as a pool alarm for an object, such as a small child, falling in. The scale factors and calculations are shown in Table 3 for each of the rays 1-5 depicted in FIGS. 14A and B. Table 3 shows the ray paths total distance and equivalent time of pulse detection, which are then plotted in FIGS. 15A and B.

The logic algorithm is depicted in FIG. 14C. It leads to Table 3 and FIGS. 15A and 15B that will detect significant changes in the pulse sequence timing, due to missing pulses and/or new echo pulses. Such changes indicate that an ultrasonically absorbent, and reflective, object has made a sudden entrance into the pool water. The process can be characterized as pattern matching or correlation detection, which are well known in the radar and sonar art.

FIG. 15C shows prior art in the active sensor pool alarm field that used path diversion, among the decision criteria; however did not use new object echoes, particularly direct reflection echoes, among the decision criteria, for enabling the alarms. Furthermore, the prior art does not cover the entire water volume, but only a relatively thin horizontal layer.

The current invention's wide beamwidth is obtained with the same acousto-optics components disclosed and described in Table 1 and FIGS. 3A-F and no transducer assembly structural changes are necessary.

When an object the size of a small child, or larger, falls in to the water we can observe the qualitative effects on the reflection structure in FIG. 14B. A child's ultrasonic properties are such that the previous reflection pattern, as exemplified in FIG. 14A with only water in the pool 1, 2, and 3 will be significantly changed due to rays being absorbed, scattered and reflected. FIG. 14B rays 2 and 3 are thus blocked from completing their previous paths. Also, new echo rays 4 and 5 are introduced by the child 13 in the water in generally earlier time slots, because the paths are direct or, if reflective bounces, shorter in total distance and time. Only the direct vertical ray 1 to the water level will normally remain unaffected, as shown in FIGS. 14A and 14B.

FIGS. 14A and B are a simple model that we can use for approximating ray path segments and converting to total distance and time to observe a more quantitative object detection process. Table 3 shows the scaling applied to FIGS. 14A and B, and calculates total ray travel distances and times. The timing of these direct echoes and multiple bounce reflections are plotted in FIG. 15A for the water only reference case of FIG. 14A; and FIG. 15B does the same for the object in the water case of FIG. 14B.

It is seen from the time plots of FIGS. 15A and B that the water level echo, ray 1 in FIG. 14B remains the same, as expected, but rays 2 and 3 from FIG. 14A are missing pulses in FIG. 15B because the object has blocked those paths. Rays 2 and 3 are shown dotted in FIG. 15B to emphasize where they were on the timebase before the object had entered the water. Likewise, FIG. 15B shows two new rays 4 and 5, at much earlier times; due to the object in the water providing both a direct echo (ray 4) and an echo with fewer intermediate reflection bounces (ray 5) compared with FIG. 15A.

In an actual pool there would be many more reflection rays to consider but there are certain angles of incidence that produce much stronger reflections (e.g. 45° is a low loss bounce, and 90° is a strong specular reflection. Since it is only necessary to produce a detectable difference, based on an object entering the water, the combinations of missing pulses and new pulses will require only a relative few of the total possibilities. As in the entrapment prevention mode, range gates are used to define a reference pattern when only water is in the pool. It is the change in which range gates have echo pulses, for both new echoes and for missing pulses, that is the algorithm behind the alarm decisions. As shown in FIG. 14C the same types of echoes, produced by the same embodiment, can be digitized and stored 7 conventionally with comparators, flip-flops and shift registers, for one or more scans; and then used as a reference to compare 8 with a new scan. If the time scans are identical, or at least within a predetermined tolerance, no action need be taken 9. If, however, significant changes are found by the comparison process the panic alarms are triggered, and immediate help is demanded.

Since no swimmers are expected to be using the pool when the alarm mode is set, the ultrasonic pulse peak power level can be increased significantly and the pulse repetition rate reduced, keeping the average power the same. This increases signal to noise ratios per pulse, and thereby increases detection probability and reduces false alarm probability. When an alarm is triggered the ultrasonic power level is returned to normal.

As stated, this invention provides continuous coverage over the entire pool water volume, whereas prior art products and a patent, FIG. 15C (Curry; 5638048; Jun. 10, 1997) cover only a relatively thin layer beneath the surface of the pool water level. Covering the volume assures a greater probability of detection, since many more scans will be subject to meeting detection criteria, over a short period on the order of a few seconds, and throughout the full water depth.

Range gates that cover the necessary time slots are also a preferred embodiment for the falling-in alarm mode as well as for the primary mode of entrapment avoidance, 72-79. The patterns will be dependent upon the dimensions and geometry of each pool and can be optimized by the choice of ultrasonic frequency, pulse width, pulse repetition rate, and detection thresholds within the context described. Thus, a limited amount of fine-tuning will allow a wide range of requirements to be accommodated. It is clear that thorough testing of each such installation is a requirement to provide assurance that the CPSC defined performance requirements are met.

Since it is assumed that the pool has been empty of swimmers, this sudden change in the details of the aggregate echo responses will be used to trigger both indoor and outdoor panic alarms 39 to immediately summon help and, hopefully, rescue the victim. Such alarms can also be transmitted to any other location desired, but obviously time is of the essence in this situation.

Additional Embodiments

FIGS. 1B,C;2A,C;3;3B,D,F,H;4B;5A,B;6;8B,C; 12A-F;13A,B Operational Descriptions 1. Swimmer Tracking is Possible: FIGS. 1B, C FIG. 1B is a Swim By Time History 60, and analysis of the range 66 from the drain cover 14 versus time 67 as a swimmer 13 passes by. Shown are the range gates considered as safe "OK" 61 and unsafe "No-Go" 62. FIG. 1C shows Swimmer 13 Drain Approach Trajectories 63-65, emphasizing the rate and angle of approach, slow 63 to fast 64 to Too Fast! 65 to a drain cover 14 by a swimmer 13, and therefore a transition from safe to an unsafe condition.

2. Beam Scanning is possible: (with reference to FIG. 3A)

The hemispherical beam pattern can also be achieved by time scanning a narrow beam over the volume coverage desired. This method trades more time for a lower power advantage. The Transmitter and Receiver, as well as the timing and Logic become more complex; but the Acousto-Optics may be simplified. Such techniques are well known in the radar and sonar prior art.

3. Alternate Ultrasonic Transducer Feeds: FIGS. 2A, 2C; 4B; 5A, B FIG. 2A shows the use of the suction piping 12 as waveguide for the ultrasonic waves, 15 to a drain 16, generated remotely. Likewise the echoes returned 25 are transferred to the remote transducer 17T. This represents a preferred embodiment where it can be used but it is limited by elbows in many retrofit installations. The use of new, ultrasonic compatible elbows, described under FIGS. 12 and 13 for new construction is a definite alternative.

FIG. 2C shows the use of a thin ultrasonic waveguide 26 feeding an ultrasonic launcher 28 in a drain in lieu of a cable and transducer in the drain 16. In this situation alternatives shown in 2C would allow a launcher 28 to connect via a thin plastic tube ultrasonic waveguide 26 that connects to the remote transmitter and receiver 22. An ultrasonic waveguide and launcher is prior art as disclosed in GE patent 5289436.

Alternative New Construction Drain Detail

FIG. 3 displays the concepts behind the unique and novel implementation of this invention, whereby several means for installing the immersed or underground transducer 17T is shown.

FIG. 3 is a detail of an alternative embodiment for new construction. The drain 16 is used as a housing for the transducer 17T or launcher 17L, where the transducer or launcher may be installed within the drain 16 on top of the bottom surface 19, or underneath the bottom 19 so that the transducer 17T need not be continuously immersed, If the transducer 17T is external to the drain bottom 19 it must be acoustically bonded to radiate perpendicularly to the bottom 19 and send waves through the cover to the water beyond. A conduit 21 houses and protects the feed cable 23 or thin plastic waveguide 20WG to the aboveground Transmit/Receive unit 22. Such an arrangement provides the most options for frequency and minimizes the attenuation losses, that occurs at higher frequencies, (See FIG. 8D) thus offering the best Small Target Detectability that is available. As in FIG. 1A the suction piping 12 can be used as the connecting conduit and would be a preferred embodiment in some installations.

4. Alternative Remote Transducer/Launcher

FIG. 4B is similar to the preferred embodiment, with the substitution of an ultrasonic waveguide 20WG interconnecting the transducer 17T, now located close to the transmitter and receiver 22; and a remote ultrasonic launcher 17L in the drain 16. An ultrasonic waveguide is prior art as disclosed in GE patent 5289436.

FIG. 5A shows the physical arrangement of a typical pump 50 and inlet side piping 53 and elbow fitting 59 leading to the underground pool drain 16, before modification.

FIG. 5B shows the preferred modification for retrofit applications wherein the suction side piping 53 is used a waveguide for the ultrasonic pulses transmitted 57 and the echoes received 58. The transducer housing 55 connects to the Transmitter/Receiver unit 22 via cable 20C. The main modification is seen to involve removing the 90 degree elbow 59 and reconnecting the piping 53 with a standard T fitting 56 that will both restore the water path and enable the transducer in housing 55 to send and receive ultrasonic waves 57 and 58 to and from the drain 16. An improved installation alternative for new construction, that uses part of the suction piping 53 as a direct waveguide is described further in FIGS. 12 and 13.

5. Means to Install a replaceable non-immersed or immersed transducer:

FIG. 6 provides some detail on the means for installing a replaceable Transducer/Launcher 17T/L under the bottom of a drain 16. Again, a conduit 53 is arranged to connect the transducer/launcher 17T/L with an appropriate cable or waveguide to the aboveground Transmitter/Receiver 22. This arrangement appears to be useful principally for new construction but, depending on circumstances could be adapted to retrofits as well.

6. Alternative Transducer and Adapter Structural Details

Figure 3F:
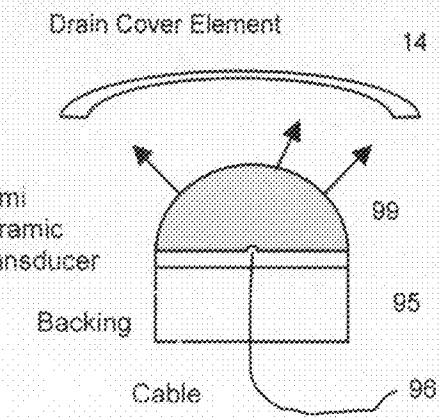

FIG. 3B, as a partial cutaway view, shows the transducer array assembly 302, or a ceramic hemispherical transducer 99, as in FIGS. 3F, 3H 86 and Table 1. Also, impedance matching network 304 and cable 330 supported by a shell structure 350 shaped as a conical frustum section. This structure both controls the transducer 302 location and orientation in the drain 16, but it also allows the free circulation of the pool water by means of a plurality of holes 340. The structure is stabilized with a ballast layer 344 retained inside by the base 360. The transducer array assembly comprised of 302 and 304 is held in position by collar 370 which is affixed to shell 350. The collar 370 may use threads or a clamp, or other method suitable for an immersed application, to hold, and position vertically, the transducer assembly 302 and 304. All materials in contact with the water are to be plastic or encapsulated in plastic for long term immersion. Since all modern pool piping and drains use PVC or ABS that determines which materials should be allowed for the structures in this application. Many marine transducers also use urethane plastics in water contact so that the exposed transducer 302 could use a thin urethane coating also.

7. Alternative Acousto-Optical Structural Configurations

The hemispherical lens 92 appears in FIG. 3D and Table 1. Prior Art is disclosed in FIG. 3G 91 and it can be seen to cover a part of the FIG. 3D structure. The purpose of this prior art was as a materials test fixture but the operating frequency, 1 MHz, and dimensions of a 50 mm hemisphere diameter 89 and 90 both relate closely to those requirements of this invention. Several differences in structure appear in the present invention and the application and purpose is completely different. The element configuration in FIG. 3F and Table 1, covers a hemispherical ceramic transducer 99 which is an attractive approach in terms of simplifying the design and minimizing the number of elements; but is very expensive due to the nature of the material involved, the processing and fabrication difficulty at a frequency of 1 Mhz and 50 mm diameter. A similar configuration is shown in FIG. 3H Prior Art 86 with test data 87 and 88 that is adequate for this invention, but not easy to compensate for drain cover anomalies, and much more costly.

8. Piping as a Direct Waveguide and Alternative Piping Elbows

The use of the water filled suction piping as a direct ultrasonic waveguide is one of the important alternative embodiments possible with the technology described herein. Early test data indicated that the piping conducted the ultrasonic pulses well with little attenuation or dispersion over much of the frequency range shown in FIG. 8D. The problem, however, was the strongly reflective, standard schedule 40, 90° PVC elbows 59 that have been used for many years for pool building throughout the United States. Since many old pools were built with a minimum of 4 and a maximum of 12 elbows in the total suction line between the drain 16 and the pump inlet 53, the attenuation would not be acceptable. However, U tube tests with 2" standard schedule 40 PVC pipe and elbows 59 have shown the feasibility of this embodiment as long as the number of elbows was limited to two or less. A U tube is constructed with two vertical and one horizontal legs, connected with two elbows. During the tests the U tube is filled with water and supported in a vertical plane, perpendicular to the floor. The transducer active face is immersed and positioned at the top of one vertical leg radiating downward as in FIG. 5B 55. The water level echo is returned from the other vertical leg. The transducer is mounted coaxially with the pipe centerline and is considered to be axi-symmetric.

In FIG. 8B, a 12 foot PVC U tube, 626 kHz, shows the reduction in attenuation with a long sweep elbow 215 compared with a conventional 90 degree Schedule 40 elbow 59 in FIG. 8C. Note also, the PVC pipe coupling echo 214 and the water level echo 216 for comparison.

FIG. 8C shows the improvement that can occur at some lower frequencies, in this case 200 kHz, 10 foot PVC U tube. All echoes are clearly identified for this U Tube test: Main Bang (transmitter pulse) 218, Elbow #1 219, Elbow #2 220, and water level echo 221.

Thus the transducer installation embodiment described in FIG. 5B is viable under the limitation of only 2 elbows. Therefore, it is a viable solution for new construction, wherein a pool deck transducer installation is adjacent to the closest pool 10 wall in line with the drain 16. This is shown in FIG. 12A. The transducer is a simple planar disk of a diameter about a half inch less than the piping ID; embedded in a plastic cylinder 40, and having it's active face immersed in the water flow at the pipe Tee 56, radiates plane waves into the water 57 and receives echoes 58.

Also, FIG. 12 discloses other methods and structure for obtaining low attenuation 900 bends in the combined water flow and ultrasonic pulse propagation through a section of the suction piping. In FIG. 12A, similar to FIG. 5B, a transducer assembly 40 is installed radiating downward into the suction piping network leading to the drain. In FIG. 12A the U tube equivalent is comprised of a J tube structure and the pool water column to water level 11.

In FIG. 12A the transducer and T/R interface 40 couple the ultrasonic pulses 57 and 58 to and from the drain 16, the suction water flow continues past the piping Tee connector 56 and returns to the pump suction inlet 53 via pipe 12. These components are housed in a deck canister 43 and can be in a dry environment. Cable 20C connects the T/R interface 40 to the remote Transmitter and Receiver 22 located at the pump equipment pad. The cable 20C is run underground in a shallow conduit in a conventional manner. The ultrasonic waves 57 and 58 propagate through the PVC piping by means of the two modified elbows 42; pass through the drain cover 14 and provide the beams in the pool above 27 and the echo reflections 20. This type of installation is a preferred embodiment for new construction. Note that if subsequent problems ever arise in the piping or underground equipment, it is a simple matter to revert to the previously described preferred embodiment for retrofit FIG. 3A with a transducer assembly 311 installed in the drain and cabled 20C to the deck canister 43, for a simple reinstallation.

The two 90° elbow fittings are a modified version of the standard schedule 40 PVC elbow 59 as shown in FIG. 12D. This modification consists of slicing off the heel of the elbow at an angle of 45°, and with a right angle to the plane of the pipe legs axis. A reflecting plate, such as a thin, flat, stainless steel, is then bonded to the cut PVC elbow with epoxy; and further coated with a thick external layer of epoxy to seal and protect the reflector 42. It is possible to, in effect, recreate the original elbow contour if the cutoff heel is rebonded. A thin coat of epoxy may be added internally to the stainless steel reflecting surface to avoid contact with the pool water.

FIGS. 12B and C show an alternative to one of the elbows 42, in the form of a 450 reflector 41 installed in the drain 16, thus requiring only one modified elbow 42, and this may reduce losses further as well as making the reflector at the drain 16 accessible from above. In FIG. 12E it is also possible to shape the in-drain reflector 41 as a concave surface to provide the focused beam for the hemispherical lens 92 that is otherwise provided by the Fresnel lens 94. This is a major simplification of the required Acoustic-Optics because only the hemispherical lens 92 need be supported by a means similar to bracket 305 as in FIG. 3*a*. FIG. 12F shows the combined modified elbow 42 with a Fresnel lens 94 and hemispherical lens 92 in the drain 16 supported by a means similar to bracket 305 as in FIG. 3A.

9. Deck Canister and Skimmer Combination: FIGS. 13A, B

The deck canister installation described in FIG. 13B is considered as a combined structure with a typical pool skimmer. For new construction this arrangement would lead to lower costs and use less deck space. FIG. 13A shows a typical pool 10 layout with a drain 16, skimmer 29 and piping to the pump 12. Also shown is a separate deck canister 43 for the present invention with it's own piping to the pump 12. FIG. 13B shows the basic components of a typical skimmer deck canister 43 set flush with the pool deck surface 49, the pool 10 wall, the pool water level 11, a skimmer weir 29, canister cover 48, debris filter chamber, debris basket, the water pipe 45 from the main drain, and the return flow pipe to the pump intake 44. The only additional component to be added is the transducer and T/R interface 40 and a pipe Tee 56 with one foot of added pipe to combine the installations. The transducer assembly 40 is connected to the remote Transmitter and Receiver 22 with cable 20C. As described for FIG. 12A, the transducer is a simple planar disk of a diameter about a half inch less than the piping ID; embedded in a plastic cylinder 40, and having it's active face immersed in the water flow at the pipe Tee 56, radiates plane waves into the water 57 and receives echoes 58. It is of a type called a "puck" due to it's shape used with some fishfinders, although at lower frequencies and with lower damping. Higher frequencies and relatively heavy damping are required for the present invention to achieve better range resolution. This combined installation shows that the transducer package is at least partially immersed, but it could be in a dry subcompartment with some simple modifications, that are well understood from prior art, by one skilled in the art.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A system that is hydraulically independent to provide anticipatory, automatic, suction drain entrapment prevention for a user of a swimming pool, spa, or wading pool, the system comprising:

(a) a water filled vessel, a water circulation means, at least one underwater suction drains with covers, piping connections, and an active ultrasonic sensor transmitter producing electronic pulses;

(b) a transducer assembly to convert said electronic pulses into ultrasonic echo pulses that radiate from within said at least one suction drain, through said at least one covers of said drain, to said water beyond said drain cover;

(c) an ultrasonic sensor receiver for detecting ultrasonic echo pulses from said at least one drain covers, a water level or a vessel wall, and user that is in a predetermined proximity to the at least one drain covers;

(d) said ultrasonic echo pulses pass through said drain cover to the location of said transducer assembly;

(e) said ultrasonic echo pulses is converted to input electronic signal pulses by said ultrasonic sensor receiver and logic circuits in combinations providing a predetermined decision criteria based upon said sequence of echo pulses including those from said drain cover, said water level, or the opposite vessel wall, and said user in a NO-GO range gate, or said user in an OK range gate;

(f) a control means for automatically stopping water flow via said water circulation means, based on the presence or absence of each of said at least one echo pulses from the at least one drain covers, said water level or said vessel wall, and said user that is in a predetermined proximity to the at least one drain covers in said sequence of echo pulses; wherein said control means determines if said user is in said predetermined proximity to the at least one suction drain, if said drain cover is not present by automatically self-calibrating to determine if said drain cover echo pulse is within a predetermined range, and if said water level is not within a predetermined range by automatically self-testing to determine if said water level echo pulse is within the predetermined range so as to stop water flow to prevent suction entrapment.

2. The system of claim 1, wherein ultrasonic or electronic pulses are transferred through said water filled suction piping by one of:

(a) an electronic cable from aboveground to said suction drain and transducer, (b) an ultrasonic waveguide from aboveground to said suction drain and launcher, and (c) an ultrasonic wave from an aboveground transducer coupled to the water filled said suction piping transiting into said drain and said pool beyond.

3. The system of claim 1, wherein the ultrasonic pulses that radiate from within said suction drain are formed from one of:

(a) a transducer acousto-optical assembly consisting of a planar transducer, a spherical focusing lens, a hemispherical beam-forming lens and said drain cover, (b) a transducer acousto-optical assembly consisting of a planar transducer, a planar spherical focusing lens, a hemispherical beam-forming lens and said drain cover, (c) a transducer acousto-optical assembly consisting of a hemispherical transducer-beam-former, and said drain cover, (d) a transducer acousto-optical assembly consisting of a transducer located aboveground, coupled ultrasonically to the water filled said suction piping, as a waveguide thereby coupled to said drain, where are the planar focusing lens, hemispherical beam-forming lens, and said drain cover, and (e) a transducer acousto-optical assembly consisting of a transducer located above-ground, coupled to a thin, flexible ultrasonic waveguide carried within said water-filled suction piping to said drain, where said waveguide terminates in a launcher device providing a point focus for a hemispherical lens, and said drain cover.

4. The system of claim 1, wherein said transducer assembly is made entirely or in part of ceramic, polymer, composite, or piezoelectric material.

5. The system of claim 1, wherein (a) an ultrasonic transducer connected to a remote electronic transmitter and receiver, with a coaxial or balanced line cable led through the suction piping system from the drain to an aboveground location for the installation of said electronic transmitter and receiver; and (b) said aboveground location is preferred as the pool pump equipment pad, where the suction piping emerges from the ground in typical existing pool installations.

6. The system of claim 1, wherein (a) an ultrasonic transducer connected to a remote electronic transmitter and receiver, with a coaxial or balanced line cable led through the suction piping system from the drain to an aboveground location, for the installation of said electronic transmitter and receiver interface;

(b) said aboveground location is preferred as an intermediate junction box or canister in the pool deck inline with the drain, and serves as a housing for the transmit and receive interface, and a receiver preamplifier to further transmit the echoes to the remainder of said remote electronic transmitter and receiver with an underground conduit, but not immersed, cable; and (c) said cable includes separate conductors or sub-cables for carrying the transmitter electronic pulses to the said underwater transducer in said drain, and the received said electronic echo pulses to the said pool pump equipment pad, where the remainder of said remote electronic transmitter and receiver means is housed.

7. The system of claim 1, wherein said drain connected to a remote ultrasonic transducer and electronic transmitter and receiver, with the suction piping system acting as an ultrasonic waveguide from said drain to an aboveground location suitable for the installation of said transducer and electronic transmitter and receiver.

8. The system of claim 1, wherein said drain connected to a remote ultrasonic transducer and electronic transmitter and receiver, with a thin flexible plastic, fluid filled tube ultrasonic waveguide and launcher, as led through the suction piping system from said drain to an aboveground location for the installation of said transducer electronic transmitter and receiver housing; the launcher being housed and supported within the drain enclosure in a similar manner to that used for a transducer assembly with a support bracket sandwiched between the drain rim flange and the drain cover.

9. The system of claim 1, wherein the ultrasonic transducer assembly structure providing a generally hemispherical radiation pattern, having a central axis coaxial with said drain cover, in a predefined region of the pool in close proximity to said drain, comprising:

(a) an ultrasonic transducer to be housed and supported within said drain enclosure, a predetermined distance behind said drain cover;

(b) said ultrasonic transducer connected to a remote electronic transmitter and receiver, with a coaxial or balanced line cable led through the suction piping system from said drain to a convenient aboveground location for the installation of said electronic transmitter and receiver;

(c) said transducer assembly and cable capable of long term immersion in pool water;

(d) said transducer assembly supported within said drain enclosure, independent of said drain cover, whether said drain cover is present or missing;

(e) said predetermined minimum distance from said ultrasonic transducer radiating surface to said drain cover inside surface thereby controlled;

(f) with said drain cover removed, said transducer assembly supporting structure flange to be fastened to said drain enclosure rim flange, fitting between said drain enclosure rim flange and said drain cover when reinstalled; and (g) fasteners for said drain cover through said ultrasonic transducer assembly flange clearance holes, to an underlying drain rim flange; whereby, a missing or damaged drain cover will be detected by said ultrasonic sensor due to significant changes in said drain cover echo pulses.

10. The system of claim 1, wherein the transducer assembly has a generally hemispherical radiation pattern comprises a cylindrical, single element, spherical focusing, planar ceramic transducer in conjunction with a hemispherical lens.

11. The system of claim 1, wherein the transducer assembly has a generally hemispherical radiation pattern comprises a hemispherical, thin wall ceramic dome, ultrasonic transducer capable of generating said radiation pattern without a lens.

12. The system of claim 1, wherein the ultrasonic sensor receiver has piezoelectric transducers comprising:

(a) a plurality of piezoelectric transducer elements mounted in the distal end of a cylindrical housing;

(b) a transducer acousto-optic focusing lens providing a point focus on the center of the flat surface of said hemispherical acousto-optical lens;

(c) hemispherical acousto-optic lens and said suction drain cover assembly mounted forward of said transducer elements in said cylindrical housing, and at a predetermined distance behind said drain cover;

(d) a transducer assembly support bracket attached directly with first screw fasteners to a suction drain rim flange and coaxial with said suction drain, having a plurality of attachment legs, allowing free water circulation through said transducer assembly support bracket and said suction drain;

(e) said cylindrical housing is of such diameter as to allow clearance all around said suction drain wall to allow free passage of water;

(f) said cylindrical housing is mounted coaxial with said drain cover, in said transducer assembly support bracket having a clearance hole to accept a threaded hollow extension of said cylindrical housing distal end, with cable, fastened with a matching nut, both to fasten the cylindrical housing and establish the predetermined spacing between said hemispherical acousto-optical lens assembly and the interior surface of said drain cover;

(g) said drain cover also attaches, with second screw fasteners, directly to said suction drain rim flange via clearance holes in said transducer—assembly support bracket, such that said transducer assembly support bracket is sandwiched between said suction drain rim flange and said drain cover, but not fastened to said drain cover;

(h) said cable feeds through said threaded hollow extension of said cylindrical housing, and via said suction drain exit piping to a predetermined location above ground, where it connects to electronic transmit and receive circuits of said ultrasonic sensor device; and (i) where said cable joins said transducer in said cylindrical housing inductive matching components are housed to compensate for the large capacitive loads based on said transducer and said cable of variable length; whereby, a missing or damaged drain cover will be detected by said ultrasonic sensor due to significant changes in the amplitude and timing of said drain cover echo pulses; whereby, said ultrasonic sensor, working with said logic and control elements can foresee and preclude said swimmer entrapment, entanglement, or evisceration at said suction drains.

13. The system of claim 12, wherein said ultrasonic sensor has operating frequency in the range of 200 khz to 2 mhz.

14. The system of claim 12, wherein said hemispherical type of beam produced by said acousto-optical lens or said hemispherical transducer is in the range of 120° to 160° in elevation and 360° in azimuth at the −6 db points.

15. The system of claim 12, wherein said focusing lens f number is in the range of 1 to 2.

16. The system of claim 1, wherein said electronic circuit comprises:

(a) an analog threshold, based on a pulse coincidence detector producing a digital logic pulse when said detection threshold is exceeded;

(b) a combinatorial logic processor to allow comparisons for each of the five logical decision criteria combination based upon said echo pulse data;

(c) of the five combinations, two decision criteria represent normal operation with no apparent hazard, and two other decision criteria require immediate flow control action to avoid a pending entrapment, and one requires action to deduce the reason for the loss of all echo pulses beyond the drain cover echo pulse; whereby, said pulses being processed to determine that:

(1) said drain cover is in place, or not (2) swimmer detected within the predetermined NO-GO radius, stop flow (3) swimmer detected beyond the predetermined NO-GO radius, OK (4) water level or opposite wall echo is normal, or not.

17. A method for automatically preventing a user of a swimming pool, spa, or wading pool from suction drain entrapment, the method comprising the steps of:

(a) providing a water filled vessel, a water circulation means, one or more underwater suction drains with covers, piping connections, and an active ultrasonic sensor transmitter producing electronic pulses, (b) providing a transducer assembly to convert said electronic pulses into ultrasonic echo pulses that radiate from within said suction drain, through said cover of said drain, to said water beyond said drain cover, (c) receiving ultrasonic echo pulses from said drain cover, said water level or said vessel wall, and the user echo pulses, in a predetermined proximity to said drain cover, (d) guiding said ultrasonic echo pulses passing through said drain cover to the location of said transducer assembly, (e) converting said ultrasonic echoes to said electronic signal pulses processed by an ultrasonic sensor receiver and logic circuits in combinations providing unambiguous, predetermined decision criteria based upon said sequence of echoes including those from said drain cover, said water level or opposite pool wall, and said swimmer in a NO-GO range gate, or said swimmer in an OK range gate, (f) utilizing a control means to automatically stop water flow via said water circulation means, based on the presence or absence of each of said at least one echo pulses from the at least one drain covers, said water level or said vessel wall, and said user that is in a predetermined proximity to the at least one drain covers in said sequence of echo pulses; wherein said control means determines if said user is in said predetermined proximity to the at least one suction drain, if said drain cover is not present by automatically self-calibrating to determine if said drain cover echo pulse is within a predetermined range, and if said water level is not within a predetermined range by automatically self-testing to determine if said water level echo pulse is within the predetermined range so as to stop water flow to prevent suction entrapment.

18. The method of claim 17, further including a swimming pool fall-in alarm comprising the steps of:

(a) providing said broad beamwidth transducer or said transducer plus said hemispherical lens within a bottom mounted said pool suction drain;

(b) creating a full-coverage network of reflections from said water surface, said pool walls, and said pool bottom, in an unoccupied said swimming pool;

(c) establishing normal assemblage of said reflected pulse characteristics due to the number of said reflections in said unoccupied pool from said water to air surface, and said pool walls and bottom;

(d) using time gate sampling for missing pulse detection and new echo pulse reception, so that when an object having similar acoustic characteristics to a small child falls into said pool water, it will produce a detectable change in said normal reflected pulses of said reflection network, because said object is absorbing and reflecting, thus blocking said normal reflected pulse signature and adding new echo pulses compared with said unoccupied pool water volume; and (e) detecting such a disturbance of said normal reflections causes visual and aural panic alarms to be initiated immediately for both indoor and outdoor locations via a display and a sound system.

19. The system of claim 1, further comprises an active ultrasonic sensor comprising:

(1) piezoelectric transducer means for transmitting sound waves from within a pool suction drain, passing through said drain cover in a substantially hemispherical beam, into said pool water beyond, for receiving corresponding echo pulses from predetermined objects of interest in the path of said sound waves including said drain cover, swimmers, and the water level or the pool wall opposite said drain; and for generating electrical signals in accordance with said received echo pulses;

(2) electrical transmitter means coupled to said transducer means for controlling transmission of said sound waves by said transducer means;

(3) receiver means coupled to said transducer means for receiving and processing said electrical signals produced by said transducer means and for producing an output in accordance therewith;

(4) processor means coupled to said receiver means for converting said output of said receiver means into electrical data representative of the slant range from the transducer assembly hemispherical surface to each said predetermined object of interest within a predetermined distance of said drain cover, and providing an output in accordance therewith;

(5) decision logic means coupled to said processor means for converting said output of said processor means into an electrical control signal means based on said predetermined decision criteria means as to whether a hazardous entrapment environment has occurred, or is foreseen to occur very shortly based on said slant range data, wherein all said predetermined objects of interest said slant range data are evaluated in predetermined, unambiguous, combinations means, many times per second, in accordance with said decision criteria and having an output in accordance therewith;

(6) flow control means coupled to said decision logic means for using said output of said decision logic means, to deactivate the pool circulation means if such action has been commanded by said predetermined decision criteria means; likewise, when said decision criteria means finds no hazard present said predetermined decision criteria command will call for reactivation of the pool circulation means;

(7) said flow control means also using predetermined criteria, will attempt flow reactivation after a several seconds time delay, if no hazard is defined by the said decision criteria means at that time, the number of times said flow reactivation is allowed in a 30 second period is predetermined, as is the use of alarm means for predetermined situations when repeated said deactivations and said reactivations have occurred very quickly, indicating that personal intervention is needed to evaluate any problem or hazard to swimmers;

(8) automatic self-testing means are provided by continually locating said water level or wall echo within a predetermined range;

(9) automatic self-calibrating means are provided by continually locating said drain cover echo within a predetermined range; and

(10) fail-safe means are incorporated in the said logic and control priorities such that, due to a device failure, wherein both said deactivate and reactivate commands are output, the only action taken is to deactivate said water flow and initiate said alarms.

* * * * *